US012808368B2

(12) United States Patent
Lee et al.

(10) Patent No.: US 12,808,368 B2
(45) Date of Patent: Nov. 24, 2026

(54) RECIPROCATING COMPRESSOR

(71) Applicant: LG Electronics Inc., Seoul (KR)

(72) Inventors: Kyungmin Lee, Seoul (KR); Youngboo Son, Seoul (KR); Mingeon Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 28 days.

(21) Appl. No.: 18/830,106

(22) Filed: Sep. 10, 2024

(65) Prior Publication Data

US 2025/0116266 A1 Apr. 10, 2025

(30) Foreign Application Priority Data

Oct. 4, 2023 (KR) ..... 10-2023-0131813

(51) Int. Cl.
*F04B 39/12* (2006.01)
*F04B 35/04* (2006.01)

(52) U.S. Cl.
CPC ..... *F04B 39/127* (2013.01); *F04B 35/04* (2013.01); *F04B 39/121* (2013.01); *F04B 39/122* (2013.01)

(58) Field of Classification Search
CPC ..... F04B 39/127; F04B 39/122; F04B 35/04; F04B 39/121; F04B 39/14; F04B 39/0005
See application file for complete search history.

(56) References Cited

U.S. PATENT DOCUMENTS 3,606,594 A * 9/1971 Lewis ..... F25B 31/02 417/415
4,431,383 A * 2/1984 Boehmler ..... F04B 39/127 417/415
4,566,865 A * 1/1986 Nishitsuji ..... F04B 39/127 29/897
4,808,085 A * 2/1989 Nishitsuji ..... F04B 39/127 417/363
10,781,805 B2 9/2020 Kim
11,009,019 B2 * 5/2021 Kim ..... F04B 39/125
2005/0186090 A1 * 8/2005 Park ..... F04B 39/0094 417/902
2010/0083826 A1 * 4/2010 Iversen ..... F04B 39/122 92/169.2

FOREIGN PATENT DOCUMENTS

CN 114251245 A 3/2022
DE 102008024671 A1 * 11/2009 ..... F04B 39/122
DE 102008024671 B4 10/2015
(Continued)

OTHER PUBLICATIONS

Extended European Search Report in European Appln. No. 24201231.8, mailed on Feb. 19, 2025, 9 pages.

*Primary Examiner* — Matthew T Largi
(74) *Attorney, Agent, or Firm* — Fish & Richardson P.C.

(57) ABSTRACT

A reciprocating compressor includes a shell, a driving motor, a drive shaft, a piston, a cylinder block, and a support plate disposed between the driving motor and the cylinder block to support the cylinder block with respect to the drive motor in an axial direction of the drive shaft. The support plate has one side surface coupled to the stator and another side surface coupled to the cylinder block. The reciprocating compressor is light-weighted and/or miniaturized by reducing a weight of the cylinder block, and perpendicularity and roundness with respect to the cylinder portion and the bearing portion is secured to improve reliability.

24 Claims, 11 Drawing Sheets

(56) References Cited

FOREIGN PATENT DOCUMENTS

| | | | | | |
|---|---|---|---|---|---|
| EP | 0524552 | A1 | * | 1/1993 | ..... F04B 39/127 |
| JP | S59180084 | A | * | 10/1984 | |
| JP | 2005-240760 | A | | 9/2005 | |
| KR | 10-2003-0083367 | A | | 10/2003 | |
| KR | 10-2004-0078960 | A | | 9/2004 | |

* cited by examiner

RECIPROCATING COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2023-0131813, filed on Oct. 4, 2023, the contents of which are incorporated by reference herein in their entirety.

TECHNICAL FIELD

This disclosure relates to a reciprocating compressor.

BACKGROUND

A reciprocating compressor may include a piston that suctions, compresses, and discharges refrigerant into a compression chamber, where the piston is disposed inside a cylinder while performing a reciprocating motion inside the cylinder. In some cases, the cylinder may be a part of a cylinder block manufactured by casting, and may be configured as a single body extending from a frame portion supporting a drive shaft in radial and axial directions of the drive shaft. In some cases, the cylinder may be defined as a cylinder portion, and disposed eccentrically in a radial direction of the drive shaft at one side of the frame portion that is a part of the cylinder block.

In some cases, the cylinder block may be made by casting such that a bearing portion extending in an axial direction of the drive shaft to support the drive shaft in a radial direction is disposed at a center of the frame portion and a plurality of fixing protrusions are disposed at corners of the frame portion to protrude toward a stator in an axial direction of the drive shaft. Accordingly, the cylinder block may be coupled to the stator to be elastically supported against a shell.

In some cases, a cylinder portion may be a single body integrally with a bearing portion supporting a drive shaft. This configuration may provide perpendicularity between the cylinder portion and the bearing portion and roundness of the cylinder portion. In some cases, a fixing protrusion for fastening a cylinder block to a stator may extend from a frame portion to constitute a single body integrally with the cylinder portion and the bearing portion. In some cases, a shape of the cylinder block including the cylinder portion, the bearing portion, the frame portion, and the fixing protrusion may be complicated, and a weight of the cylinder block may be increased, which may limit reduction of a weight and/or size of a compressor.

In some cases, a cylinder block may include a cylinder portion assembled to a frame portion. This configuration may variously change a shape of the cylinder block including the cylinder portion. In some cases, as a cylinder portion and a bearing portion are post-assembled, perpendicularity between the cylinder portion and the bearing portion and/or roundness of the cylinder portion may not be secured. In some cases, the frame portion and a fixing protrusion may be configured as one single body and manufactured by casting, which may still limit reduction of a weight and/or size of a compressor.

SUMMARY

The present disclosure describes a reciprocating compressor having an advantage in weight reduction and/or miniaturization.

The present disclosure further describes a reciprocating compressor in which parts manufactured by casting can be minimized to easily manufacture and reduce a weight of a cylinder block including a cylinder portion.

The present disclosure further describes a reciprocating compressor in which a fixing protrusion for fixing a cylinder block to a stator can be excluded from the cylinder block, but the cylinder block can be stably and easily coupled to the stator.

The present disclosure further describes a reciprocating compressor in which perpendicularity between a cylinder portion and a bearing portion can be maintained, and simultaneously roundness of the cylinder portion can be secured.

According to one aspect of the subject matter described in this application, a reciprocating compressor includes a shell, a driving motor that is disposed inside the shell and includes a stator and a rotor, a drive shaft coupled to the rotor of the driving motor, a piston coupled to the drive shaft and configured to perform a reciprocating motion, a cylinder block including (i) a cylinder portion that receives the piston and defines a compression chamber with the piston and (ii) a bearing portion that receives the drive shaft and supports the drive shaft in a radial direction of the drive shaft, and a support plate that is disposed between the driving motor and the cylinder block and supports the cylinder block from the driving motor in an axial direction of the drive shaft, where the support plate has one side surface coupled to the stator and another side surface coupled to the cylinder block. Thus, the reciprocating compressor can be light-weighted and/or miniaturized by reducing a weight of the cylinder block, and perpendicularity and roundness with respect to the cylinder portion and the bearing portion can be secured to improve reliability.

Implementations according to this aspect can include one or more of the following features. For example, the support plate can include a first block support portion that supports the cylinder block in the axial direction of the drive shaft, and a plurality of second block support portions that are each bent or curved from the first block support portion toward the stator and disposed on the stator, where the stator supports the plurality of second block support portions in the axial direction of the drive shaft. Thus, the support plate can be made of sheet metal to easily manufacture the support plate, and a weight of the support plate can be reduced.

In some implementations, the first block support portion and the plurality of second block support portions have a same thickness in the axial direction of the drive shaft. Thus, a shape of the cylinder block can be simplified, and a volume of the cylinder block can be decreased, thereby reducing a weight of a compression unit.

In some implementations, the first block support portion can define a bearing accommodating portion that passes through the first block support portion in the axial direction of the drive shaft and surrounds at least a portion of the bearing portion, and a cylinder accommodating portion that is one open side of the bearing accommodating portion in the radial direction of the drive shaft and accommodates at least a portion of the cylinder portion. Thus, since the first block support portion can be configured to have an arc shape to overlap the cylinder portion in the axial direction of the drive shaft, a frame portion of the cylinder block can have a small thickness.

In some implementations, each of the plurality of second block support portions can include a bent portion that is bent from the first block support portion toward an axial side surface of the stator and extends in the axial direction of the drive shaft, and a support portion that is bent from an end of the bent portion and extends along the axial side surface of the stator, the support portion being supported by the axial side surface of the stator in the axial direction of the drive shaft. Thus, volume of the cylinder block can be reduced, and the cylinder block can be coupled to the stator by the support plate to be spaced apart from the stator by a preset height.

In some examples, the compressor can include a plurality of stator fastening members that pass through the stator, each of the stator fastening members being coupled to the support portion of one of the plurality of second block support portions. Thus, assembly work on the stator and the support plate coupled to the stator can be unified to reduce a number of assembly processes.

In some examples, the support portions can be bent from the bent portions, respectively, in a same direction along a reciprocating direction of the piston. Thus, bending work on the plurality of support portions can be simplified to improve machinability of the support plate including the plurality of support portions.

For example, the cylinder portion can be disposed at a first side with respect to an axial center axis of the rotor that is perpendicular to the reciprocating direction of the piston, where the support portions includes a first support portion disposed at the first side with respect to the axial center axis of the rotor and is bent in a direction toward an inner circumferential surface of the shell facing the cylinder portion in the reciprocating direction of the piston, and a second support portion that is disposed at a second side with respect to the axial center axis of the rotor opposite to the first side and is bent in the direction toward the inner circumferential surface of the shell. Thus, fastening of the first support portion located on the side on which the cylinder portion is disposed can be simplified, and an overturning moment of the cylinder block can be decreased by securing a long support length of the support plate.

In some examples, the first support portion can be disposed at the first side with respect to the axial center axis of the rotor and is bent in a direction away from an inner circumferential surface of the shell facing the cylinder portion in the reciprocating direction of the piston, and the second support portion can be disposed at a second side with respect to the axial center axis of the rotor opposite to the first side and is bent in the direction away from the inner circumferential surface of the shell. Thus, since a support length supporting the side on which the cylinder portion is disposed is configured to be great, the cylinder portion which is relatively heavy can be stably supported.

In some implementations, the support portions are bent from the bent portions, respectively, in opposite directions to each other along a reciprocating direction of the piston. Thus, sheet metal work on the support plate can be easily performed.

For example, in some examples, the first support portion can be disposed at the first side with respect to the axial center axis of the rotor and is bent in a first direction away from an inner circumferential surface of the shell facing the cylinder portion in the reciprocating direction of the piston, and the second support portion can be disposed at a second side with respect to the axial center axis of the rotor opposite to the first side and is bent in a second direction toward the inner circumferential surface of the shell. Thus, since a support length of the support plate can be configured to be great, the cylinder block can be stably supported.

In some examples, the first support portion can be disposed at the first side with respect to the axial center axis of the rotor and is bent in a first direction toward an inner circumferential surface of the shell facing the cylinder portion in the reciprocating direction of the piston, and the second support portion can be disposed at a second side with respect to the axial center axis of the rotor opposite to the first side and is bent in a second direction away from the inner circumferential surface of the shell facing the cylinder portion. This can minimize a length of the support plate to minimize a weight of the support plate.

In some implementations, the support plate can include at least one curved or bent portion; and at least one reinforcement rib disposed at the at least one curved or bent portion. Thus, even when the second block support portions including an extension portion are disposed to be bent from the first block support portion, rigidity of the second block support portion can increase to stably support the cylinder block.

In some implementations, the compressor can include a stopper protrusion that protrudes from the support plate in the axial direction of the drive shaft and is in contact with the cylinder block, where the stopper protrusion supports at least a part of the cylinder block in a reciprocating direction of the piston. The stopper protrusion can be at least partially located on a line passing through a center of the cylinder portion when being projected in an axial direction of the drive shaft. Thus, as the stopper protrusion supports the cylinder block in a reciprocating direction of the piston, the cylinder block can be suppressed from being pushed against the support plate due to repetitive reciprocating motions of the piston to stably support radial and/or axial directions of the cylinder block.

For example, the stopper protrusion can be disposed to be bent to overlap the cylinder block in the axial direction of the drive shaft. Thus, the block support portion can be configured such that the cylinder block is placed on the first block support portion and supported in the axial direction of the drive shaft to be stably supported on the support plate.

In addition, the cylinder block can include a block protrusion protruding in the axial direction of the drive shaft to face the stopper protrusion in a radial direction of the drive shaft. The stopper protrusion can be fastened to the block protrusion with a separate fastening member or caulked to the block protrusion. This can facilitate assembling of the cylinder block and the support plate.

In some examples, the cylinder block can be made of a first material, and the support plate can be made of a second material that is lighter than the first material of the cylinder block. For example, the cylinder block can be made of cast iron, and the support plate can be made of aluminum. Accordingly, a weight of the cylinder block can be decreased to reduce a whole weight of the compression unit.

In some implementations, the compressor can include a separate block fastening member that passes through the cylinder block and the support plate and fastens the cylinder block and the support plate to each other. For instance, the cylinder block and the support plate can be fastened or caulked to each other by the separate block fastening member penetrating through the cylinder block and the support plate. Accordingly, the cylinder block can be easily and firmly coupled to the support plate.

For example, one selected from the cylinder block and the support plate can be provided with a caulking protrusion, and another can be provided with a caulking hole or a caulking groove to have the caulking protrusion inserted and coupled therein. Thus, the cylinder block and the support plate can be easily and firmly coupled to each other.

According to another aspect, a reciprocating compressor includes a shell, a driving motor that is disposed inside the shell and includes a stator and a rotor, a drive shaft coupled to the rotor of the driving motor, a piston coupled to the drive shaft and configured to perform a reciprocating motion, a cylinder block including (i) a cylinder portion that receives the piston and defines a compression chamber with the piston, and (ii) a bearing portion that receives the drive shaft and supports the drive shaft in a radial direction of the drive shaft, and a support plate that is disposed between the driving motor and the cylinder block and supports the cylinder block from the driving motor in an axial direction of the drive shaft. Thus, the reciprocating compressor can be light-weighted and/or miniaturized by reducing a weight of the cylinder block, and perpendicularity and roundness with respect to the cylinder portion and the bearing portion can be secured to improve reliability.

Implementations according to this aspect can include one or more of the following features. For example, the support plate includes a block support surface portion that supports the cylinder block in the axial direction of the drive shaft, and a plurality of block support protrusions that are each bent or curved from the block support surface portion toward the stator and disposed on the stator, where the stator supports the plurality of block support protrusions in the axial direction of the drive shaft. Thus, not only the support plate can be made of sheet metal to easily manufacture the support plate, but also a weight of the support plate can be reduced.

In some examples, the block support surface portion can include a surface that faces the cylinder portion and is recessed in an arc shape defining one side of the block support surface portion. Thus, since the cylinder block has a small thickness in correspondence with overlapping of the cylinder block with the block support surface portion, a weight of the cylinder block can be further reduced.

In some implementations, the plurality of block support protrusions are arranged (i) symmetrical with respect to a first center line that extends in a reciprocating direction of the piston and (ii) asymmetrical with respect to a second center line that is perpendicular to the first center line and extends in the axial direction of the rotor. Thus, as a part of the block support protrusions are bent toward the shell, assembly work on the support plate can be simplified.

In some implementations, the plurality of block support protrusions are arranged symmetrical with respect to (i) a first center line that extends in a reciprocating direction of the piston and (ii) a second center line that is perpendicular to the first center line and extends in the axial direction of the rotor. Thus, since support lengths for the plurality of block support protrusions are configured to be same, stability of the cylinder block can be improved.

In some examples, the plurality of block support protrusions can be curved or bent from corners of the block support surface portion, respectively, where the stator has a polyhedral shape with a plurality of corners, each of the plurality of corners supporting one of the plurality of block support protrusions in the axial direction of the drive shaft. Accordingly, as the plurality of block support protrusions are arranged widely in a radial direction from a center of the frame portion, support force of the support plate can be uniformly distributed to stably support the cylinder block.

In some examples, at least one of the plurality of block support protrusions is bent from an intermediate portion between corners of the block support surface portion. Thus, a number of the block support protrusions can be decreased, thereby reducing a weight of the support plate in correspondence with the decreased number of the block support protrusions, and at the same time, reducing a number of assembly processes.

In some examples, at least one of the plurality of block support protrusions is located at a first center line that extends in a reciprocating direction of the piston. Thus, the support force for the cylinder block can be increased while reducing a number of block support protrusions.

In some examples, the stator has a polyhedral shape with a plurality of corners, and the stator includes a plate support protrusion that is disposed between the plurality of corners of the stator and protrudes outward in the radial direction, where the plate support protrusion supports at least one of the plurality of block support protrusions in the axial direction of the drive shaft. Thus, volume of the stator can be minimized and a support area for the support plate can be stably secured.

In some implementations, the block support surface portion can include a first extension portion that is disposed between ends of the block support surface portion and extends outward in a first direction, where at least one of the plurality of block support protrusions is bent from the first extension portion and supported on the plate support protrusion of the stator. Thus, an area of the support plate in a reciprocating direction of the piston can be decreased, thereby reducing a weight of the compression unit including the support plate.

In some implementations, the block support surface portion further includes a second extension portion that is disposed at at least one of the ends of the block support surface portion and extends outward in a second direction, where one of the plurality of block support protrusions is bent from the second extension portion and supported on one of the plurality of corners of the stator. Thus, an area of the support plate in a direction perpendicular to the reciprocating direction of the piston can be decreased, thereby reducing a weight of the compression unit including the support plate.

BRIEF DESCRIPTION OF THE DRAWINGS

The above and other aspects, features and other advantages of the present disclosure will be more clearly understood from the following detailed description taken in conjunction with the accompanying drawings.

DETAILED DESCRIPTION

Description will now be given of a reciprocating compressor according to one or more implementations disclosed herein, with reference to the accompanying drawings. Generally, reciprocating compressors can be divided into an upper compression type and a lower compression type according to positions of a compression unit. The upper compression type is configured such that a compression unit is located above a motor unit, whereas the lower compression type is configured such that a compression unit is located below a motor unit. Hereinafter, a description will be provided mainly about an upper compression type reciprocating compressor, but this can be applied to a lower compression type reciprocating compressor.

In addition, hereinafter, a side on which a compression chamber is located with reference to a piston is defined as a front side, and an opposite side is defined as a rear side for description. In addition, a side on which the compression chamber is located with reference to a motor unit is defined as an upper side, and an opposite side is defined as a rear side.

Figure 1:
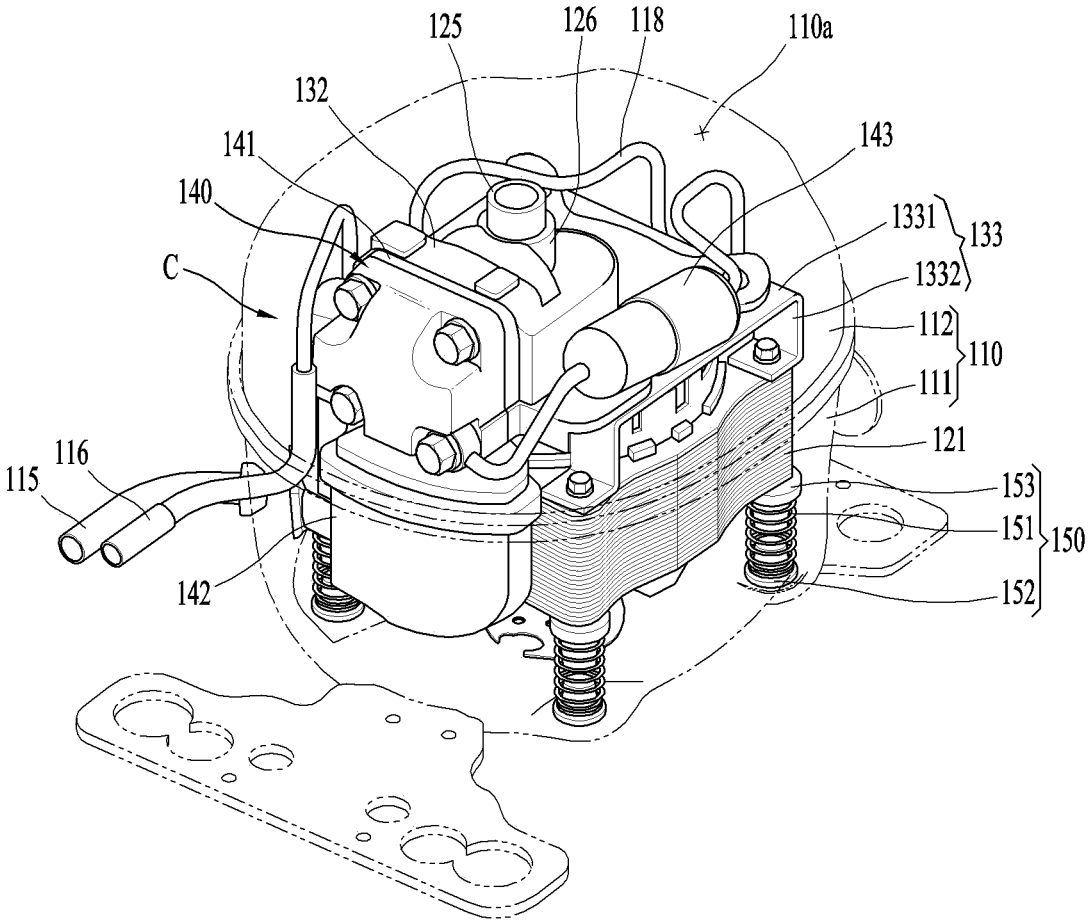
FIG. 1 is a perspective projection view illustrating an inside of a shell of an example of a reciprocating compressor.
Figure 2:
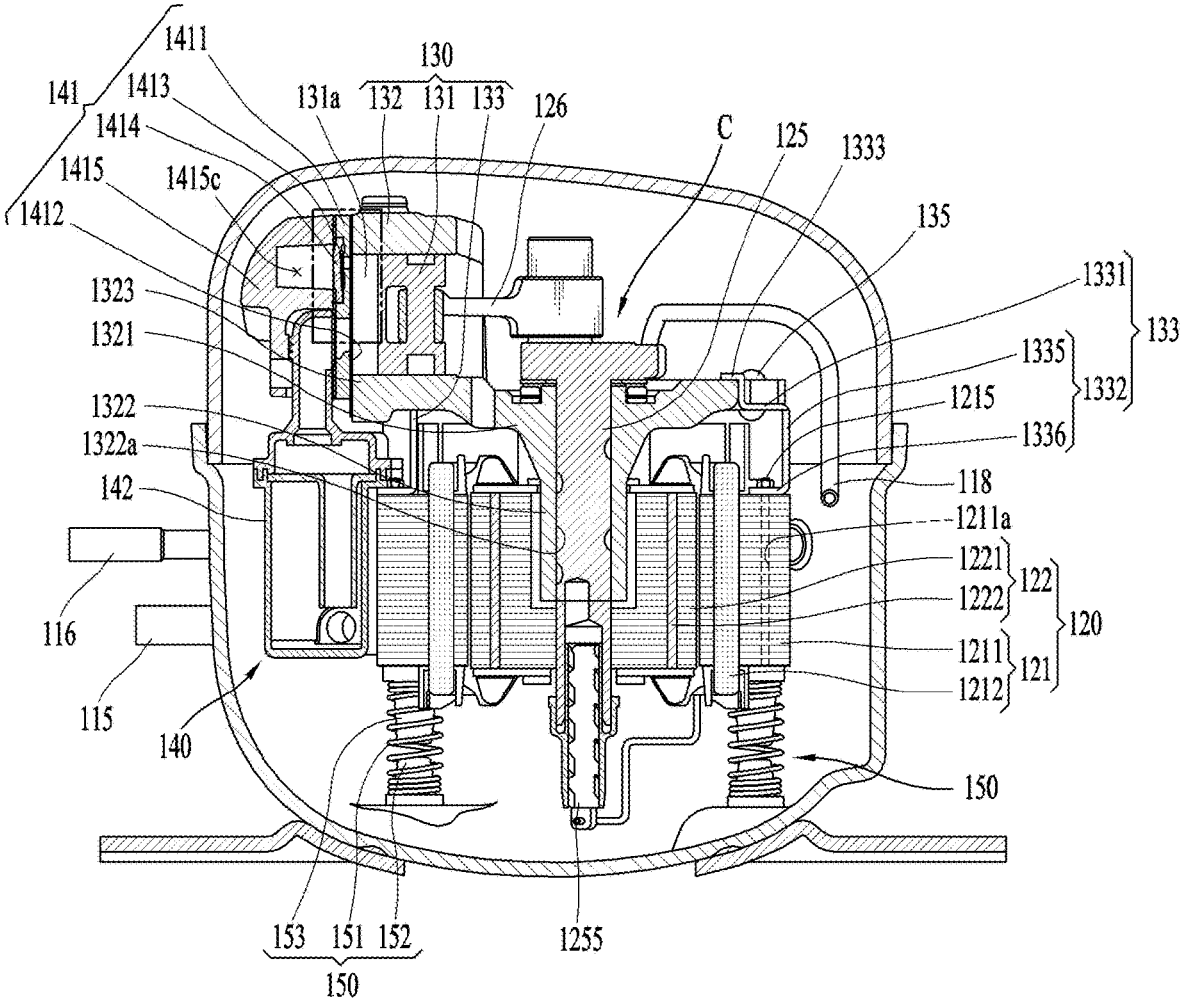
FIG. 2 is a sectional view illustrating an inside of the reciprocating compressor of FIG. 1.

FIG. 1 is a perspective projection view illustrating an inside of a shell of an example of a reciprocating compressor. FIG. 2 is a sectional view illustrating an inside of the reciprocating compressor of FIG. 1.

In some implementations, referring to FIGS. 1 and 2, the reciprocating compressor includes a shell 110 defining an outer appearance, a motor unit 120 included in an inner space 110*a* of the shell 110 and configured to provide driving force, a compression unit 130 configured to receive the driving force from the motor unit 120 and compress refrigerant, a suction/discharge unit 140 configured to guide the refrigerant to a compression chamber and discharge the compressed refrigerant, and support portions 150 configured to support a compressor main body C including the motor unit 120 and the compression unit 130 with respect to the shell 110.

In detail, the shell 110 includes a lower shell 111 and an upper shell 112. The lower shell 111 and the upper shell 112 can be combined to each other to define the inner space 110*a* which is enclosed. The motor unit 120 and the compression unit 130 can be accommodated in the inner space 110*a* of the shell 110. The shell 110 can be made of an aluminum alloy (hereinafter, abbreviated as aluminum) having a light weight and a high thermal conductivity.

The lower shell 111 can be configured to have an approximately hemispherical shape. A suction pipe 115, a discharge pipe 116, and a process pipe can penetrate and be coupled into the lower shell 111. The suction pipes 115, the discharge pipes 116, and the process pipes can each be coupled into the lower shell 111 using an insert die casting method.

The upper shell 112 can be configured to have an approximately hemispherical shape like the lower shell 111. The upper shell 112 can be coupled to the lower shell 111 on an upper side of the lower shell 111 to define the inner 110*a* of the shell 110 described above.

In addition, the upper shell 112 and the lower shell 111 can be combined with each other by welding. However, when made of an aluminum material that is difficult to weld, the lower shell 111 and the upper shell 112 can be fastened with bolts.

Referring to FIGS. 1 and 2, the motor unit (or driving motor) 120 can include a stator 121 and a rotor 122. The stator 121 can be elastically supported against the inner space 110*a* of the shell 110, i.e., a bottom surface of the lower shell 111, and the rotor 122 can rotatably equipped inside the stator 121.

The stator 121 can include a stator core 1211 and a stator coil 1212.

The stator core 1211 is made of a metal material such as an electrical steel sheet, and when a voltage is applied to the motor unit 120 from outside, performs an electromagnetic interaction through electromagnetic force together with the stator coil 1212, which will be described later, and the rotor 122.

The stator core 1211 is configured to have a shape of approximately a rectangular box and/or a hollow hexahedron. For example, an inner circumferential surface of the stator core 1211 can be configured to have a circular shape, and an outer circumferential surface thereof can be configured to have an approximately rectangular shape. The stator core 1211 can be coupled to a support plate 133, which will be described later, by stator fastening members 1215 to be elastically supported by the shell 110.

In other words, first fastening holes 1211*a* are disposed through corners of the stator core 1211 along an axial direction of a drive shaft 125, respectively, and the stator fastening members 1215 configured to fasten support portions 1336 of the support plate 133, which will be described later, to the stator core 1211 can be inserted into the first fastening holes 1211*a*, respectively. In this case, the stator fastening members 1215 can be fastened into the first fastening holes 1211*a* in the support portions 1336, which will be described later, by penetrating through the first fastening holes 1211*a*, or fastened into the first fastening holes 1211*a* in one side surface (an upper surface) of each of the support portions 1336 facing away from the stator core 1211 using a nut, etc. by sequentially penetrating through the first fastening holes 1211*a*. The stator core 1211 will be described later together with the support plate 133.

When the stator core 1211 is spaced apart from an inner surface of the shell 110 in an axial direction and a radial direction of the drive shaft 125, a lower end of the stator core 1211 can be supported by a support spring 151, which will be described later, with respect to a bottom surface of the shell 110. Accordingly, vibration generated during operation can be suppressed from being directly transmitted to the shell 110.

The stator coil 1212 can be wound inside the stator core 1211. As described above, when a voltage is applied from outside, the stator coil 1212 generates electromagnetic force to perform an electromagnetic interaction together with the stator core 1211 and the rotor 122. By doing so, the motor unit 120 generates a driving force for a reciprocating motion of the compression unit 130.

The rotor 122 includes a rotor core 1221 and a magnet 1222.

The rotor core 1221 is made of a metal material such as an electrical steel sheet like the stator core 1211, and can be configured to have an approximately cylindrical shape. The drive shaft 125 can be press-fitted into a center of the rotor core 1221.

The magnet 1222 is made of a permanent magnet and can be inserted to be coupled at equal intervals along a circumferential direction of the rotor core 1221. When voltage is applied, the rotor 122 rotates through electromagnetic interaction with the stator core 1211 and the stator coil 1212. Accordingly, the drive shaft 125 rotates together with the rotor 122 to transmit rotational force of the motor unit 120 to the compression unit 130 through a connecting rod 126.

Referring to FIGS. 1 and 2, the compression unit 130 can include a valve assembly 141, a cylinder block 132, and the support plate 133. The piston 131 is a member coupled to the drive shaft 125 by the connecting rod 126 to perform a reciprocating motion. The cylinder block 132 is a member into which the piston 131 is inserted to perform a reciprocating motion and define a compression chamber 130*a*. The support plate 133 is a member disposed between the stator 121 and the cylinder block 132 to fix the cylinder block 132 to the stator 121.

A side (a rear side) of the piston 131 facing toward the connecting rod 126 can be open, whereas an opposite side (a front side) facing away from the connecting rod 126 can have a closed and flat shape. Accordingly, the connecting rod 126 is inserted and rotatably coupled into a rear side of the piston 131, and a front side of the piston 131 defines the compression chamber 130*a* inside a cylinder portion 1323 together with a valve assembly 141, where the cylinder portion 1323 and the valve assembly 141 will be described later.

The cylinder block 132 can include a frame portion 1321, a bearing portion 1322, and the cylinder portion (cylinder) 1323. The frame portion 1321 connects the bearing portion 1322 to the cylinder portion 1323 to be supported on the support plate 133 which is to be described later in an axial direction of the drive shaft 125. The bearing portion 1322 includes a bearing hole 1322*a* to support the drive shaft 125 in a radial direction. The cylinder portion 1323 can extend from the frame portion 1321 to define the compression chamber 130*a* together with the piston 131. Thus, the frame portion 1321 of the cylinder block 132 is configured to have a thin and narrow shape. Accordingly, as volume of the cylinder block 132 can be decreased, a weight of the compression unit 130 including the cylinder block 132 can be reduced. The cylinder block 132 will be described later together with the support plate 133.

The support plate 133 can include a block support surface portion 1331 and a block support protrusion 1332. The cylinder block 132 can be placed on the block support surface portion 1331 and supported in an axial direction of the drive shaft 125. The block support protrusion 1332 can extend from the block support surface portion 1331 and be placed on the stator core 1211 to be supported in an axial direction of the drive shaft 125. Accordingly, a weight of the cylinder block 132 including the support plate 133 can be reduced by replacing a part of the cylinder block 132 manufactured by casting with the support plate 133 obtained by performing sheet metal work. The support plate 133 will be described later together with the stator 121 and the cylinder block 132.

Referring to FIGS. 1 and 2, the suction/discharge unit 140 can include the valve assembly 141, a suction muffler 142, and a discharge muffler 143. The valve assembly 141 and the suction muffler 142 can be sequentially coupled from an open end of the cylinder portion 1323.

The valve assembly 141 can include a valve plate 1411, the suction valve 1412, a discharge valve 1414, a discharge valve stopper 1415, and a discharge cover 1416. In some examples, the valve assembly 141 can further include a gasket between the respective members described above.

The valve plate 1411 can be configured to have an approximately rectangular plate shape and installed to cover a front end surface of the cylinder block 132, i.e., one open side surface of the compression chamber 130*a*. For example, fastening holes (no reference numeral) can be disposed at corners of the valve plate 1411, respectively, to be bolted into fastening grooves (no reference numeral) disposed in the front end surface of the cylinder block 132.

The valve plate 1411 can be equipped with both side surfaces having an approximately flat shape, and a center portion having one suction port 1411*a* and one discharge port 1411*b* disposed therein. However, in some cases, a plurality of suction ports 1411*a* and/or discharge ports 1411*b* can be disposed.

The suction valve 1412 is configured as a rectangular plate made of a thin steel plate having elasticity, and can be placed on a side facing toward the piston 131, with reference to the valve plate 1411, i.e., on a rear side surface. Accordingly, the suction valve 1412 can open or close the suction port 1411*a* by being bent in a direction toward the piston 131.

The discharge valve 1414 can be configured as a long plate made of a thin steel plate and placed on a front side surface of the valve plate 1411. Accordingly, the discharge valve 1414 can open or close the discharge port 1411*b* by being curved in a direction away from the piston 131.

The discharge valve stopper 1415 can be configured as a rigid body and disposed between the discharge valve 1414 and the discharge cover 1416. One end of the discharge valve stopper 1415 can be in close contact with the discharge valve 1414, and another end thereof can be spaced apart from the discharge valve 1414 by a preset distance. Accordingly, the discharge valve stopper 1415 can press and fix the discharge valve 1414 onto the valve plate 1411 and, simultaneously, limit an opening amount of the discharge valve 1414.

The discharge cover 1416 can be fastened to a front end surface of the cylinder block 132 to have the valve plate 1411 and the suction valve 1412 interposed therebetween to thereby ultimately cover the compression chamber 130*a*. In other words, the discharge cover 1416 can also be referred to as a cylinder cover. Accordingly, as the discharge valve 1414 is opened, refrigerant discharged from the compression chamber 130*a* through the discharge port 1411*b* can move to the discharge muffler 143 via the discharge cover 1416.

Referring to FIGS. 1 to 2, the suction muffler 142 can be fixed by the valve assembly 141 to communicate with the suction port 1411*a* of the valve plate 1411. A suction space portion (no reference numeral) can be disposed in the suction muffler 142, and an inlet of the suction space portion can communicate directly or indirectly with the suction pipe 115, and an outlet of the suction space portion can directly communicate with a suction side of the valve assembly 141. Accordingly, the suction muffler 142 can transmit refrigerant suctioned through the suction pipe 115 to the compression chamber 130*a* of the cylinder portion 1323.

Referring to FIGS. 1 and 2, the discharge muffler 143 can be equipped to be separate from the cylinder block 132. A discharge space portion (no reference numeral) can be disposed in the discharge muffler 143. An inlet of the discharge space portion can be connected to a discharge side of the valve assembly 141 by a loop pipe 118. An outlet of the discharge space portion can be directly connected to the discharge pipe 116 by the loop pipe 118. Accordingly, the discharge muffler 143 can attenuate a pressure pulsation of refrigerant discharged from the compression chamber 130*a*, and discharge the refrigerant to outside of the compressor through the discharge pipe 116.

Referring to FIGS. 1 and 2, the support portions 150 support a space between a lower surface of the motor unit 120 and a bottom surface of the lower shell 111 facing the lower surface of the motor unit 120. The support portions 150 generally support four corners of the motor unit 120 against the shell 110. For example, the support portions 150 can each include the support spring 151, and a first spring cap 152 and a second spring cap 153 both supporting a lower end of the support spring 151.

The support spring 151 is made of a compression coil spring. The first spring cap 152 is fixed to the bottom surface of the lower shell 111 to support the lower end of the support spring 151. The second spring cap 153 is fixed to a lower end of the motor unit 120 to support an upper end of the support spring 151. Accordingly, each support spring 151 is supported by each first spring cap 152 and each second spring cap 153 to elastically support the compressor main body C with respect to the shell 110.

In the drawings, an undescribed reference numeral 1255 denotes an oil feeder.

The reciprocating compressor operates as described below.

That is, when power is applied to the motor unit 120, the rotor 122 rotates. When the rotor 122 rotates, the drive shaft 125 coupled to the rotor 122 rotates to transmit rotational force to the piston 131 through the connecting rod 126. The piston 131 performs a reciprocating motion in a back-and-forth direction in the compression chamber 130*a* by the connecting rod 126.

For example, when the piston 131 moves backward (suction stroke) in the compression chamber 130*a*, volume of the compression chamber 130*a* increases. When the volume of the compression chamber 130*a* increases, refrigerant filled in the suction muffler 142 passes through the suction valve 1412 of the valve assembly 141 to be suctioned into the compression chamber 130*a* of the cylinder portion 1323.

Conversely, when the piston 131 moves forwards (discharge stroke) in the compression chamber 130*a*, volume of the compression chamber 130*a* decreases. When the volume of the compression chamber 130*a* decreases, refrigerant filled in the compression chamber 130*a* is compressed, passes through the discharge valve 1414 of the valve assembly 141, and is discharged into the discharge chamber 1416*a* of the discharge cover 1416. The discharged refrigerant flows into the discharge space portion of the discharge muffler 143 through the loop pipe 118, and is discharged back through the loop pipe 118 and the discharge pipe 116 as a refrigeration cycle. This series of process is repeatedly performed.

In some implementations, the compression unit 130 is coupled to the motor unit 120 as described above and constitute the compressor main body C together with the motor unit 120 to be elastically supported by the support portion 150 including the support spring 151. Thus, a weight of the compressor main body C can be reduced by reducing a weight of the motor unit 120 and/or the compression unit 130. By doing so, the compressor can have a small size and/or a light weight, and compressor vibration can be reduced to allow to perform high load operation (high pressure and/or high-speed operation).

In some implementations, a volume of a cylinder block constituting a part of a compression unit can be decreased to reduce a weight and/or a size of a compressor main body and a reciprocating compressor including the compressor main body.

Figure 3:
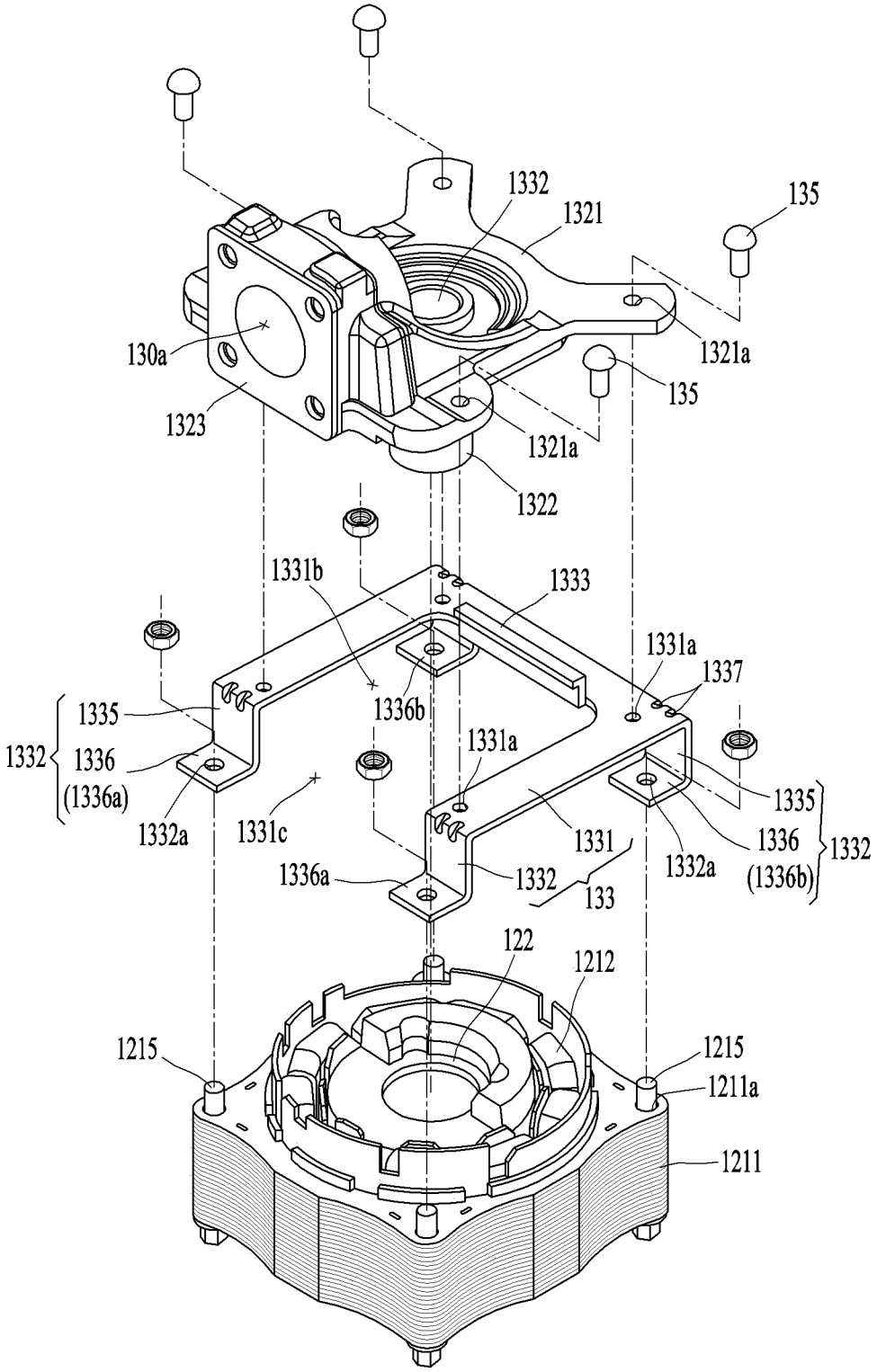
FIG. 3 is an exploded perspective view illustrating an example of a compressor main body.
Figure 4:
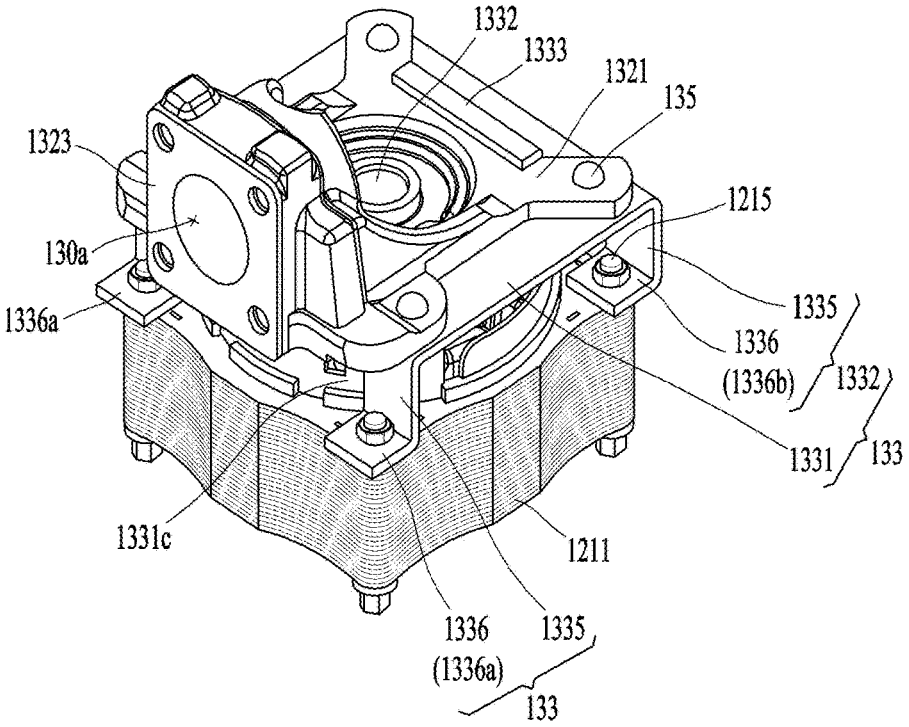
FIG. 4 is an assembled perspective view illustrating the compressor main body of FIG. 3.
Figure 5:
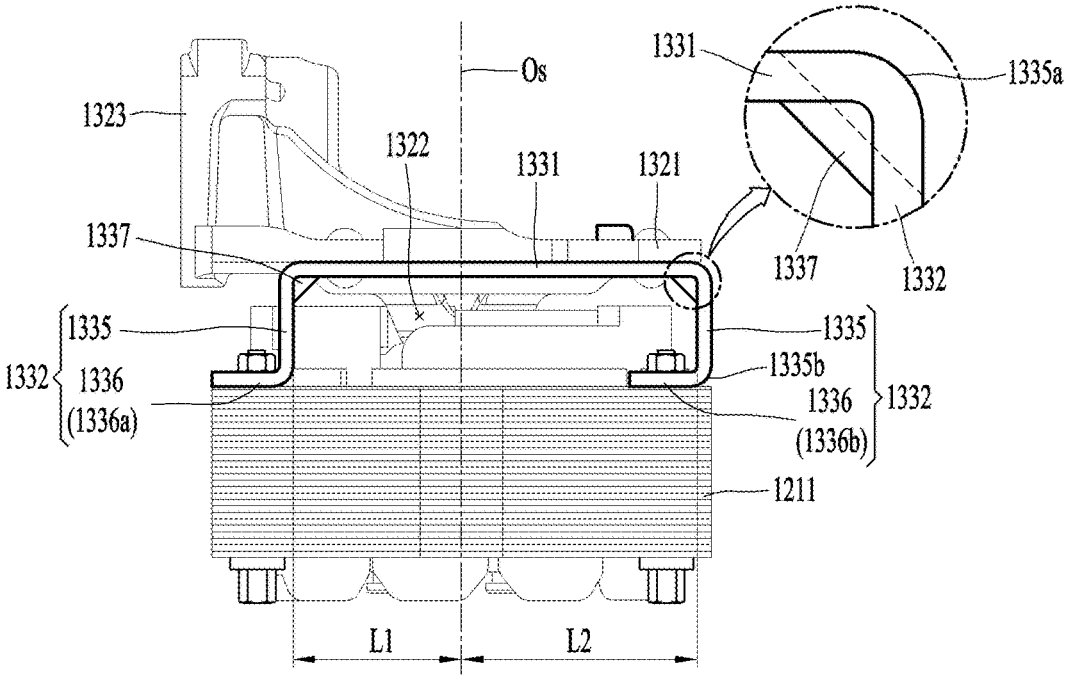
FIG. 5 is a front view of FIG. 4.
Figure 6:
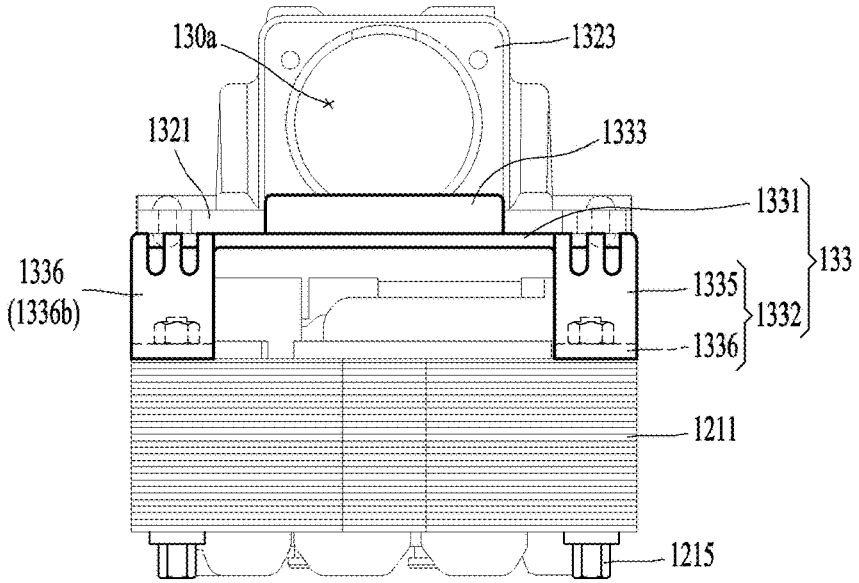
FIG. 6 is a side view of FIG. 4.
Figure 7:
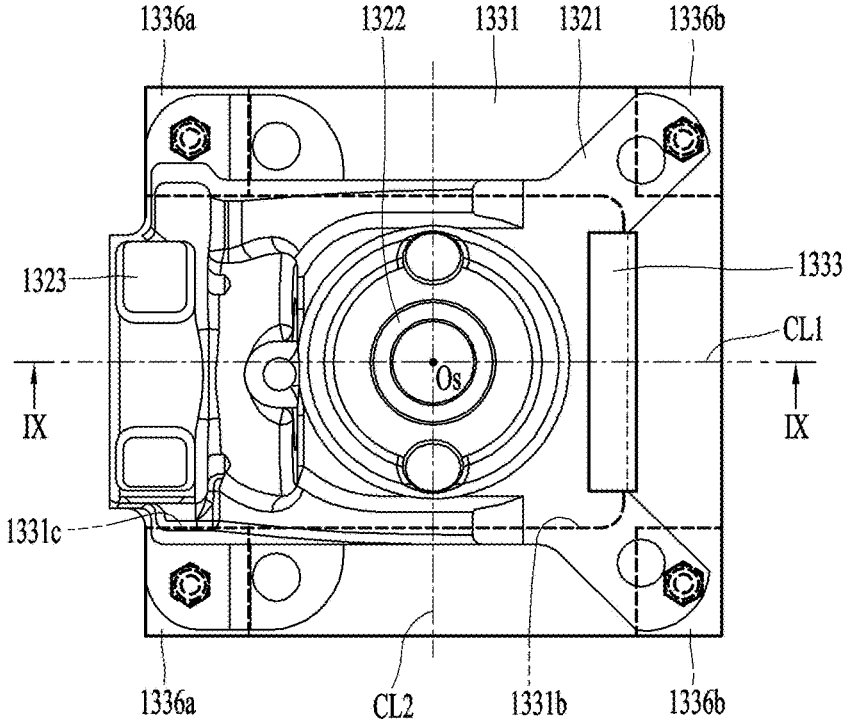
FIG. 7 is a plan view of FIG. 4.
Figure 8:
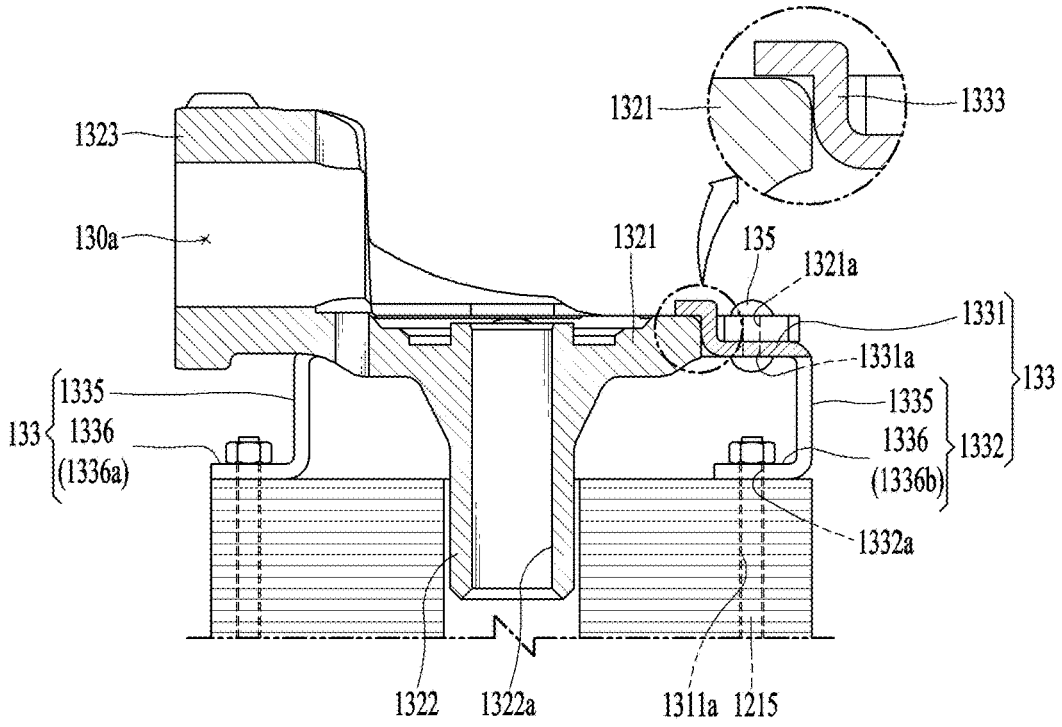
FIG. 8 is a sectional view taken along line "IX-IX" of FIG. 7.

FIG. 3 is an exploded perspective view of a compressor main body. FIG. 4 is an assembled perspective view illustrating the compressor main body of FIG. 3. FIG. 5 is a front view of FIG. 4. FIG. 6 is a side view of FIG. 4. FIG. 7 is a plan view of FIG. 4. FIG. 8 is a sectional view taken along line "IX-IX" of FIG. 7.

Referring to FIGS. 3 to 8, the compression unit 130 can include the piston 131, the cylinder block 132, and the support plate 133 as described above. The piston 131 can be coupled to the drive shaft 125 by the connecting rod 126 to be slidably inserted into the cylinder portion 1323. The cylinder block 132 can be coupled to the support plate 133 to be supported in an axial direction of the drive shaft 125. The support plate 133 can be coupled to the stator 121 to be supported in an axial direction of the drive shaft 125. Accordingly, the cylinder block 132 can be coupled to the stator 121 by the support plate 133 to be elastically supported by the shell 110.

For example, the piston 131 can be manufactured by casting. In other words, the cylinder block 132 can be configured as a single body in which the frame portion 1321, the bearing portion 1322, and the cylinder portion 1323, which will be described later, are manufactured by casting. Accordingly, perpendicularity between the bearing portion 1322 and the cylinder portion 1323 can be secured, and at the same time, roundness in the bearing portion 1322 and the cylinder portion 1323 can be secured. Thus, behavior of the piston 131 can be stabilized, and at the same time, the drive shaft 125 can be stably supported.

In detail, the cylinder block 132 can include the frame portion 1321, the bearing portion 1322, and the cylinder portion (or cylinder) 1315 as described above. The frame portion 1321 can extend in a transverse direction perpendicular to an axial direction of the drive shaft 125. The bearing portion 1322 can extend from a center of the frame portion 1321 in an axial direction of the drive shaft 125. The cylinder portion 1323 can extend from one side of the frame portion 1321 in a radial direction of the drive shaft 125.

The frame portion 1321 can be configured to have a flat plate shape extending in a radial direction (a transverse direction) of the drive shaft 125 or a radiating plate shape obtained by performing a slimming processing on some edges excluding corners. For example, the frame portion 1321 can be configured to have a radiating plate shape having portions of corners extending longitudinally in a radial direction, and second fastening holes 1321*a* can be disposed through the corners of the frame portion 1321, respectively. The second fastening holes 1321*a* can be disposed coaxially with a third fastening hole 1331*a* disposed through the block support surface portion 1331 of the support plate 133, which will be described later, in an axial direction of the drive shaft 125. Accordingly, in a state of being placed on the block support surface portion 1331 which will be described later, the frame portion 1321 can be fastened by a block fastening member 135, such as a bolt and/or a rivet, penetrating through the second fastening hole 1321*a* and the third fastening hole 1331*a*. By doing so, even when the cylinder block 132 is separated from the support plate 133, and then, post-assembled, assembling work on the cylinder block 132 and the support plate 133 can be simplified.

In addition, the frame portion 1321 can be configured to have approximately a constant thickness except for a portion on which the cylinder portion 1323 is disposed. In other words, the corner portions of the frame portion 1321 fastened to the support plate 133 can be configured to have an almost flat shape. Accordingly, whole volume of the cylinder block 132 including the frame portion 1321 can be decreased, thereby reducing a whole weight of the cylinder block 132 manufactured by casting.

The bearing portion 1322 can be disposed to extend from a center portion of the frame portion 1321 along an axial direction of the drive shaft 125. In other words, the bearing portion 1322 can extend longitudinally toward the motor unit 120 to overlap the stator coil 1212 in a radial direction.

In addition, the bearing hole 1322*a* can be disposed through the bearing portion 1322 along an axial direction of the drive shaft 125 to have a hollow shape. The drive shaft 125 can be supported at an upper end of the bearing portion 1322 in an axial direction, and a bearing portion (no reference numeral) of the drive shaft 125 can be supported on an inner circumferential surface of the bearing portion 1322 in a radial direction of the drive shaft 125. Accordingly, the drive shaft 125 can be supported by the cylinder block 132 in axial and radial directions of the drive shaft 125.

The cylinder portion 1323 can be disposed to extend from one side edge of the frame portion 1321 along a radial direction of the drive shaft 125. In other words, the cylinder portion 1323 can extend as a single body from the frame portion 1321 and be disposed eccentrically from a center of the frame portion 1321 in a radial direction of the drive shaft 125.

In addition, the cylinder portion 1323 can be penetrated in a radial direction of the drive shaft 125 to have an inner open end into which the piston 131 connected to the connecting rod 126 is inserted and an outer open end equipped with the valve assembly 141 constituting the suction/discharge unit 140 which will be described later. Accordingly, the cylinder portion 1323 can be configured to have a thickness greater than that of the frame portion 1321.

The support plate 133 can be manufactured separately from the cylinder block 132, and then, assembled as described above. Accordingly, the support plate 133 can be made of various materials and/or shapes. For example, the support plate 133 can be manufactured of a material same as or different from that of the cylinder block 132. In other words, the cylinder block 132 can be made of cast iron, whereas the support plate 133 can be made of an aluminum alloy, which is lighter than cast iron. When the support plate 133 is manufactured of a material lighter than that of the cylinder block 132, a weight of the compression unit 130 including the cylinder block 132 and the support plate 133 can be further reduced.

In addition, the support plate 133 can be manufactured by casting or can also be made by sheet metal processing. In some examples, an example in which the support plate 133 is manufactured by sheet metal processing is mainly described. When the support plate 133 is processed into sheet metal, the support plate 133 can be easily machined.

For example, the support plate 133 can be made by bending a plate material having a same thickness according to a predetermined shape. In other words, the block support protrusion 1332, which will be described later, can be configured to have a same thickness as that of the block support surface portion 1331. Accordingly, not only a shape of the cylinder block 132 can be simplified, but also volume of the cylinder block 132 can be decreased, thereby reducing a whole weight of the compression unit 130.

In detail, the support plate 133 can include the block support surface portion 1331 (or a first block support portion) and a plurality of block support protrusions 1332 (or second block support portions). The block support surface portion 1331 is a portion on which the cylinder block 132 is placed to be supported in an axial direction of the drive shaft 125. The plurality of block support protrusions 1332 are portions having end portions placed on an axial side surface (hereinafter used interchangeably with an upper side surface) of the stator core 1211 to be supported. Accordingly, the support plate 133 can constitutes a part of the compression unit 130 to be disposed between the compression unit 130 and the motor unit 120, e.g., between the cylinder block 132 and the stator 121 to couple the cylinder block 132 to the stator 121.

The block support surface portion 1331 can be configured to have various shapes. In some implementations, the block support surface portion 1331 can be configured to have a "C" shape (e.g., a bracket shape) or a "c" shape (e.g., a rotated "U" shape) similar thereto, when projected in an axial direction of the drive shaft 125. In other words, the block support surface portion 1331 can be configured to have an arc shape with both ends by being secondarily bent along a circumferential direction. Accordingly, a bearing accommodating portion 1331*b* is disposed at a center of the block support surface portion 1331 to penetrate therethrough in an axial direction of the drive shaft 125 to surround and accommodate the bearing portion 1322 of the cylinder block 132. A cylinder accommodating portion 1331*c* can be disposed to be open on one side of the bearing accommodating portion 1331*b* in a radial direction to accommodate the cylinder portion 1323. By doing so, the block support surface portion 1331 can overlap the cylinder portion 1323 in an axial direction of the drive shaft 125. Thus, the frame portion 1321 of the cylinder block 132, which will be described later, can have a small thickness, thereby reducing volume of the cylinder block 132.

The block support surface portion 1331 can be disposed to at least partially overlap the stator coil 1212 of the stator 121 in an axial direction of the drive shaft 125. In other words, an inner circumferential surface of the block support surface portion 1331 can be disposed to be located within a range of a radial direction of the stator coil 1212. Accordingly, deformation of the block support surface portion 1331 can be suppressed by securing an appropriate width of the block support surface portion 1331.

The third fastening hole 1331*a* corresponding to the second fastening hole 1321*a* in the cylinder block 132 described above can be disposed in the block support surface portion 1331. In other words, the third fastening hole 1331*a* can be disposed through corners of the block support surface portion 1331 to penetrate through an axial direction of the drive shaft 125 and be located on a same axial line as that of the second fastening hole 1321*a*. Accordingly, the block support surface portion 1331 can be firmly coupled to the frame portion 1321 of the cylinder block 132 by the block fastening member 135 inserted into the second fastening hole 1321*a* and the third fastening hole 1331*a*.

In some implementations, one of the second fastening hole 1321*a* and the third fastening hole 1331*a* described above can be configured as a caulking protrusion to be caulked to the frame portion 1321 in a state of being inserted into a fastening hole (or a fastening groove) at an opposite side. This will be described again later.

In addition, a stopper protrusion 1333 supporting the cylinder block 132 in a radial direction of the drive shaft 125 can be disposed on the block support surface portion 1331 to protrude in an axial direction of the drive shaft 125. The stopper protrusion 1333 can be disposed to be bent from an inner circumferential surface of the bearing accommodating portion 1331*b* toward a side opposite to the motor unit 120 and at least partially located on the first center line CL1 (see FIG. 7) passing through a center of the cylinder portion 1323 when being axially projected in an axial direction (or along a shaft axis) of the drive shaft 125. Accordingly, when the piston 131 moves backward (suction stroke), force transmitted to the cylinder block 132 can be attenuated to stably support the cylinder block 132.

For example, the stopper protrusion 1333 can be configured to have a flat shape extending along an axial direction of the drive shaft 125. However, the stopper protrusion 1333 can be also configured to be bent to have a shape of "¬" (e.g., a rotated "L" shape) toward the cylinder portion 1323 of the cylinder block 132 as shown in FIG. 8. In this case, the stopper protrusion 1333 can support one side surface (an upper side surface) of the frame portion 1321 in an axial direction of the drive shaft 125. Accordingly, the frame portion 1321 of the cylinder block 132 can be supported by the stopper protrusion 1333 in radial and axial directions of the drive shaft 125 to be firmly coupled to the cylinder block 132 and the support plate 133. In other words, as the stopper protrusion 1333 supports the cylinder block 132 in a reciprocating direction of the piston 131, the cylinder block 132 can be suppressed from being pushed away from the support plate 133 due to repetitive reciprocating motions of the piston 131 to stably support radial and/or axial directions of the cylinder block 132.

The plurality of block support protrusions 1332 can be disposed to be bent from respective corners of the block support surface portion 1331 having a "L" shape (e.g., a bracket shape) toward the stator core 1211. For example, when a center line in a reciprocating direction of the piston 131 is referred to as a first center line CL1 and a center line passing through an axial center Os of the drive shaft 125 and perpendicular to the first center line CL1 is referred to a second center line CL2 (see FIG. 7), the plurality of block support protrusions 1332 can be disposed at positions symmetrical to each other with reference to the first center line CL1 and positions symmetrical to each other with reference to the second center line CL2, respectively. In other words, the plurality of block support protrusions 1332 can be configured to be disposed at same or almost similar positions in all directions from a center Os (e.g., an axial center, or a center axis) of the frame portion 1321, respectively. Accordingly, as the plurality of block support protrusions 1332 are arranged radially from a center of the frame portion 1321, support force of the support plate 133 can be uniformly distributed to stably support the cylinder block 132. In addition, as the block support protrusions 1332 are disposed widely as possible on the block support surface portion 1331, the cylinder block 132 can be stably supported.

In detail, the plurality of block support protrusions 1332 can each include one bent portion 1335 and one support portion 1336. The bent portion 1335 is a portion primarily bent in the block support surface portion 1331. The support portion 1336 is a portion secondarily bent in the bent portion 1335. In other words, the block support protrusion 1332 can be bent in two steps from the block support surface portion 1331 to have a sectional shape of "L" when projected from a front. Accordingly, as a large area of the block support protrusion 1332 in contact with an axial side surface (an upper side surface) of the stator core 1211 is secured, the cylinder block 132 can be stably supported.

A plurality of bent portions 1335 can be each configured such that one end is bent from an outer circumferential surface of the block support surface portion 1331 along an axial direction (or longitudinal direction) of the drive shaft 125. In other words, the bent portions 1335 can be bent at a right angle toward an axial side surface (an upper side surface) of the stator core 1211 from respective corners including both ends of the block support surface portion 1331 having a "⊏" shape (e.g., a bracket shape). Accordingly, the block support surface portion 1331 can be located above the stator coil 1212 to, in correspondence with this, reduce volume of the support plate 133.

A height of the bent portions 1335 can be configured to be slightly greater than a height at which the stator coil 1212 protrudes from an axial side surface (an upper side surface) of the stator core 1211. For instance, the height of the bent portions 1335 can be greater than the height of the stator coil 1212 protruding from the axial side surface of the stator core 1211 by a predetermined amount. In other words, the bent portions 1335 can be configured such that the block support surface portion 1331 is slightly spaced apart from the stator coil 1212 in a state when the support portion 1336, which will be described later, is placed on an axial side surface (an upper side surface) of the stator core 1211. Accordingly, buckling of the bent portions 1335 can be effectively suppressed by minimizing a height of the bent portions 1335, even when the cylinder block 132 is placed on the block support surface portion 1331.

In some examples, the bent portions 1335 can each have at least one reinforcement rib 1337 disposed on a bent or curved portion from the block support surface portion 1331. For example, a first bending line 1335*a* from the block support surface portion 1331 and a second bending line 1335*b* from the support portion 1336 can be disposed at both ends of each of the bent portions 1335. The at least one reinforcement rib 1337 described above can be disposed at the first bending line 1335*a* and/or the second bending line 1335*b*. The reinforcement rib 1337 can be obtained by post-assembling a separate member by welding, etc., but can be obtained by performing caulking on inside of a portion bent from the first bending line 1335*a* and/or the second bending line 1335*b* as shown in FIG. 5. In some examples, an example in which the reinforcement rib 1337 is disposed on the first bending line 1335*a* is illustrated, but the reinforcement rib 1337 can be also disposed identically on the second bending line 1335*b*. Accordingly, even when the block support protrusions 1332 including the bent portions 1335 are bent from the block support surface portion 1331, since rigidity of the block support protrusions 1332 is increased, the cylinder block 132 can be stably supported.

In some examples, the plurality of bent portions 1335 can each be configured by being bent twice or more. In other words, the plurality of bent portions 1335 can be configured by being bent to have multiple steps. In this case, the reinforcement rib 1337 can be also disposed at each bent portion.

As described above, each of a plurality of support portions 1336 can be configured by being bent (in a transverse direction) from an end of each of the bent portions 1335, the end opposite to the block support surface portion 1331 along an axial side surface (an upper side surfaces) of the stator core 1211 (in a traverse direction). For example, the plurality of support portions 1336 can be disposed by being bent from the respective bent portions 1335 in a same direction as a reciprocating direction of the piston 131. Accordingly, as a bending operation on the support portions 1336 is simplified, machinability of the support plate 133 including the support portions 1336 can be enhanced.

For example, the plurality of support portions 1336 can be configured to be bent symmetrically with reference to the first center line CL1, and bent asymmetrically with reference to the second center line CL2. In other words, among the plurality of support portions 1336, a first support portion 1336*a* located on a side on which the cylinder portion 1323 is disposed with reference to the second center line CL2 can be bent to face toward an inner circumferential surface of the shell 110, and a second support portion 1336*b* located on an opposite side to the cylinder portion 1323 can be bent to face away from an inner circumferential surface of the shell 110. Accordingly, in a case of the first support portion 1336*a* located on the side on which the cylinder portion 1323 is disposed, even when the cylinder portion 1323 is disposed in a periphery, fastening of the first support portion 1336*a* can be simplified.

In some examples, as shown in FIGS. 3-5, the cylinder portion 1323 can be disposed at a first side with respect to axial center axis Os of the rotor that is perpendicular to the reciprocating direction of the piston. The support portions 1336 can include the first support portion 1336*a* disposed at the first side with respect to the axial center axis Os of the rotor and is bent in a direction (e.g., left) toward an inner circumferential surface of the shell facing the cylinder portion 1323 in the reciprocating direction of the piston, and the second support portion 1336*b* that is disposed at a second side with respect to the axial center axis Os of the rotor opposite to the first side and is bent in the direction (i.e., left) toward the inner circumferential surface of the shell.

In some examples, as shown in FIG. 7, the first support portion 1336*a* can be disposed at the first side with respect to the axial center axis Os of the rotor and is bent in a first direction (e.g., left) toward an inner circumferential surface of the shell facing the cylinder portion in the reciprocating direction of the piston, and the second support portion 1336*b* can be disposed at a second side with respect to the axial center axis Os of the rotor opposite to the first side and is bent in a second direction (e.g., right) away from the inner circumferential surface of the shell facing the cylinder portion 1323.

Figure 9:
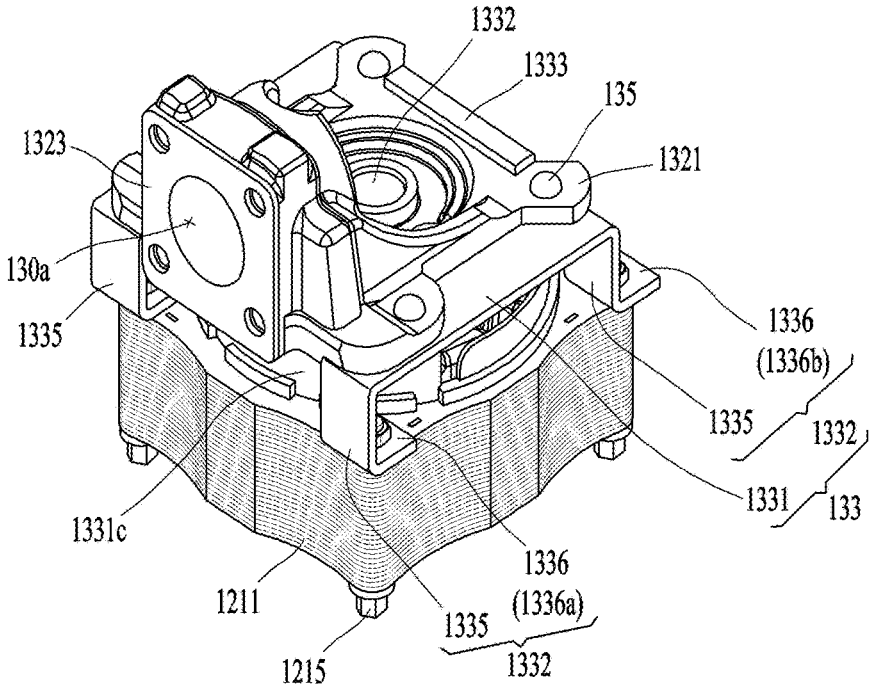
FIG. 9 is a perspective view illustrating an example of a support plate.

In some examples, as shown in FIG. 9, the first support portion 1336*a* can be disposed at the first side with respect to the axial center axis Os of the rotor and is bent in a direction (e.g., right) away from an inner circumferential surface of the shell facing the cylinder portion 1323 in the reciprocating direction of the piston, and the second support portion 1336*b* is disposed at a second side with respect to the axial center axis Os of the rotor opposite to the first side and is bent in the direction (i.e., right) away from the inner circumferential surface of the shell.

Figure 12:
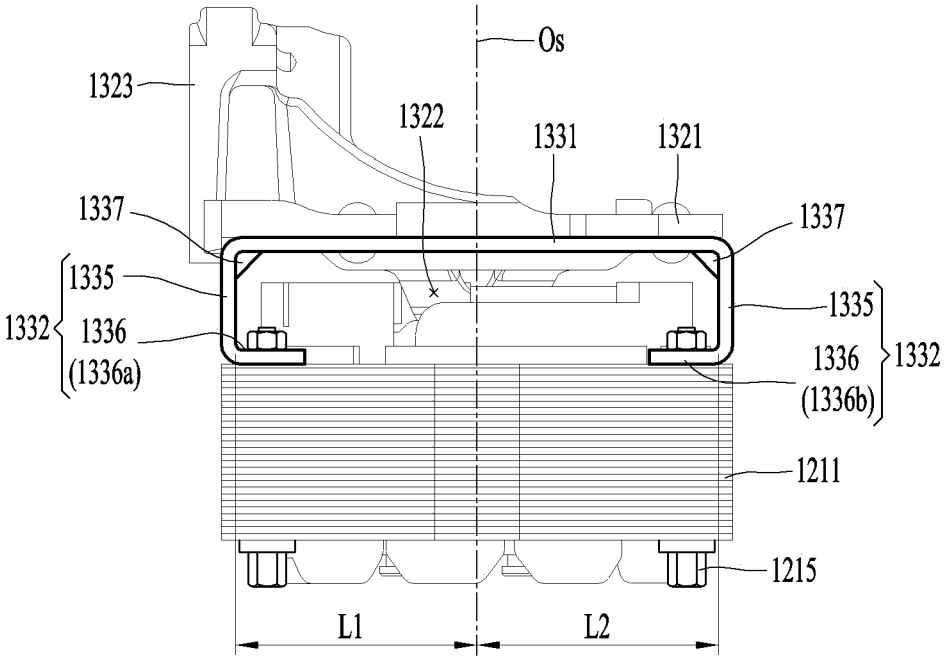
FIG. 12 is a front view of FIG. 11.

In some examples, as shown in FIG. 12, the first support portion 1336*a* can be disposed at the first side with respect to the axial center axis Os of the rotor and is bent in a first direction (e.g., right) away from an inner circumferential surface of the shell facing the cylinder portion in the reciprocating direction of the piston, and the second support portion 1336*b* can be disposed at a second side with respect to the axial center axis Os of the rotor opposite to the first side and is bent in a second direction (e.g., left) toward the inner circumferential surface of the shell facing the cylinder portion 1323.

In addition, as the block support surface portion 1331 extends longitudinally toward the opposite side to the cylinder portion 1323, the frame portion 1321 placed on the block support surface portion 1331 can be also disposed longitudinally to the opposite side to the cylinder portion 1323. In other words, as illustrated in FIG. 5, a second support length L2 to the second support portion 1336*b* can be greater than a first support length L1 to the first support portion 1336*a* with reference to the axial center Os. Accordingly, since a support point for the cylinder block 132 on the opposite side to the cylinder portion 1323 is located far away from the axial center Os of the drive shaft 125, even when a center of gravity of the cylinder block 132 is eccentric toward the cylinder portion 1323 of the cylinder block 132, an overturning moment of the cylinder block 132 can be decreased.

In this case, fourth fastening holes 1332*a* can be disposed through the plurality of support portions 1336, respectively, in an axial direction of the drive shaft 125. The fourth fastening holes 1332*a* can be disposed on a same axis as that of the first fastening holes 1211*a* in the stator core 1211 described above. Accordingly, the plurality of support portions 1336 can be coupled to the stator core 1211 by the stator fastening members 1215 (e.g., fastening bolts and/or fastening rivets) having a great length and passing through the first fastening holes 1211*a* and the fourth fastening holes 1332*a*. This can simplify an operation of assembling the support plate 133 with the stator 121 to thereby reduce a manufacturing process.

As described above, when the cylinder block 132 constituting a part of the compression unit 130 is coupled to the stator 121 using the support plate 133 made of sheet metal, volume of the cylinder block 132 can be decreased to reduce a whole weight of the compression unit 130. Accordingly, not only a weight of the compressor main body C is reduced, but also a load on the support portion 150 supporting the compressor main body C can be reduced, thereby reducing a size of the compressor. In addition, vibration generated during operation of operation of a compressor can be reduced to allow operation in various fields including high load operation.

In addition, as the cylinder block 132 is coupled to the stator 121 using the support plate 133 made of sheet metal, a portion manufactured by casting can be minimized to easily manufacture the cylinder block 132 including the cylinder portion 1323 while reducing a weight.

In addition, as the cylinder block 132 is coupled to the stator 121 using the support plate 133 that is post-assembled, even when a fixing protrusion configured to fix the cylinder block 132 to the stator 121 is excluded from the cylinder block 132, the cylinder block 132 can be stably coupled to the stator 121.

In addition, by fastening between the cylinder block 132 and the support plate 133 and/or between the stator 121 and the support plate 133 respectively using the block fastening member 135 such as a bolt and/or a rivet, a separate support plate 133 can be disposed between the cylinder block 132 and the stator 121, but the cylinder block 132 can be easily assembled onto the stator 121.

In addition, while the cylinder block 132 is coupled to the stator 121 using the support plate 133, since the bearing portion 1322 and the cylinder portion 1323 are configured as a single body in the cylinder block 132, perpendicularity between the bearing portion 1322 and the cylinder portion 1323 can be maintained, and at the same time, roundness in the bearing portion 1322 and the cylinder portion 1323 can be secured, thereby increasing compression efficiency and/or reliability.

Hereinafter, an example of a support plate is described.

In some implementations, a support portion of a support plate located on a side on which a cylinder portion is disposed in a cylinder block is bent in a direction facing toward an inner circumferential surface of a shell. However, in some cases, a support portion of a support plate located on a side on which a cylinder portion is located in the cylinder block can be bent in a direction facing away from an inner circumferential surface of the shell.

Figure 10:
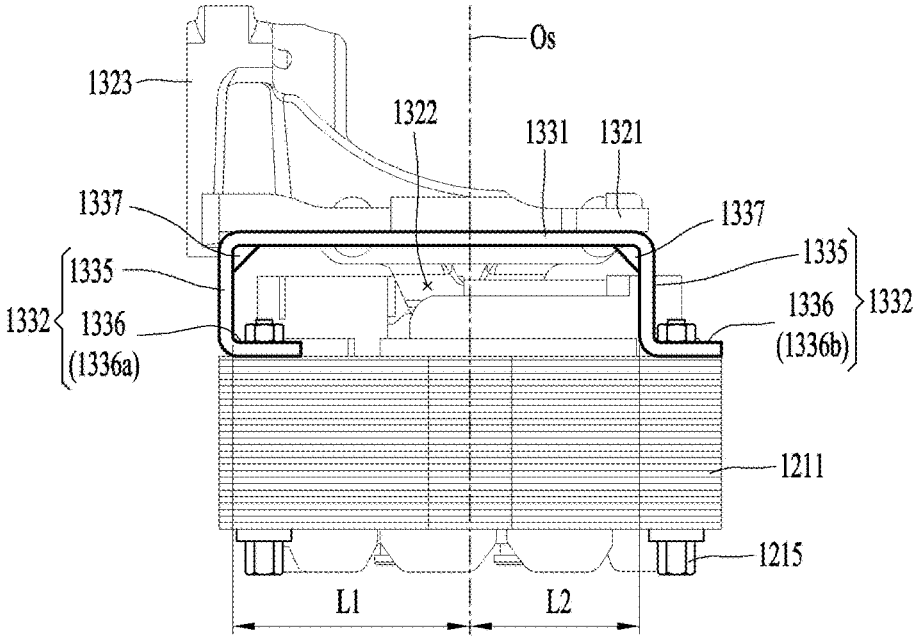
FIG. 10 is a front view of FIG. 9.

FIG. 9 is a perspective view illustrating an example of a support plate. FIG. 10 is a front view of FIG. 9.

Referring to FIGS. 9 and 10, a basic configuration and an operational effect of a compression unit 130 including a support plate 133 are similar to those of the compression unit 130 in the implementations described above. For example, the compression unit 130 can include a piston 131, a cylinder block 132, and a support plate 133, and the cylinder block 132 can be coupled to a stator 121 by the support plate 133 to be supported in an axial direction of the drive shaft 125. Accordingly, volume of the cylinder block 132 can be decreased, thereby reducing a weight of the cylinder block 132 and the compression unit 130 including the same.

The cylinder block 132 can include a frame portion 1321, a bearing portion 1322, and a cylinder portion 1323. The frame portion 1321, the bearing portion 1322, and the cylinder portion 1323 can be manufactured by casting to be configured as a single body. Accordingly, perpendicularity between the bearing portion 1322 and the cylinder portion 1323 each included in the cylinder block 132 can be maintained, and at the same time, roundness thereof can be also secured.

In addition, the support plate 133 can include a block support surface portion 1331 and a plurality of block support protrusions 1332. The block support surface portion 1331 and the plurality of block support protrusions 1332 can be manufactured of sheet metal to be configured as a single body. For example, the block support surface portion 1331 can have an approximately "⊏" shape (e.g., a bracket shape), and the plurality of block support protrusions 1332 can be disposed to be bent from respective corners including both ends of the block support surface portion 1331 toward the stator 121, respectively.

The plurality of block support protrusions 1332 can include a plurality of bent portions 1335 each bent from the block support surface portion 1331 toward an axial side surface (an upper side surface) of the stator 121, and a plurality of support portions 1336 bent from the plurality of bent portions 1335, respectively, along an axial side surface of the stator 121. Accordingly, even when the support plate 133 is manufactured of sheet metal, the cylinder block 132 can be stably supported on the stator 121.

In some implementations, among the plurality of support portions 1336, a support portion 1336 located on a side on which the cylinder portion 1323 is located, i.e., a first support portion 1336*a* located on the side on which the cylinder portion 1323 is disposed with reference to the second center line CL2 of FIG. 7 can be bent in a direction facing away from an inner circumferential surface of the shell 110. Accordingly, among the plurality of block support protrusions 1332 extending from the block support surface portion 1331, block support protrusions 1332 bent on the side on which the cylinder portion 1323 is disposed may be located farther away from a center of the cylinder block 132, i.e., the second center line CL2 (or an axial center), compared to those in the above-described implementation of FIG. 3.

As described above, when the first support portion 1336*a* located on the side on which the cylinder portion 1323 is located, among the plurality of support portions 1336, is bent in a direction facing away from an inner circumferential surface of the shell 110, the plurality of bent portions 1335 can be bent in a position adjacent to a front-end surface of the cylinder portion 1323 as possible. In other words, as illustrated in FIG. 10, with reference to an axial center Os, a first support length L1 to the first support portion 1336*a* is increased, whereas a second support length L2 to a second support portion 1336*b* can be decreased. Accordingly, since a center of the block support surface portion 1331 moves toward the cylinder portion 1323, the cylinder portion 1323 relatively heavy in the cylinder block 132 can be stably supported.

In this case, among the plurality of support portions 1336, a support portion 1336 located on a side opposite to the cylinder portion 1323, i.e., the second support portion 1336*b* located on the opposite side to the cylinder portion 1323 with reference to the second center line CL2 can be bent in a direction facing toward an inner circumferential surface of the shell 110. Thus, a geometric center of the support plate 133 can be moved toward the cylinder portion 1323 while a lateral length of the block support surface portion 1331 is maintained. Accordingly, the cylinder block 132 can be stably supported while a weight of the support plate 133 is maintained.

Hereinafter, an example of a support plate is described.

In some implementations, support portions of a support plate are bent in a same direction. In some implementations, support portions of a support plate can be bent in directions different from each other.

Figure 11:
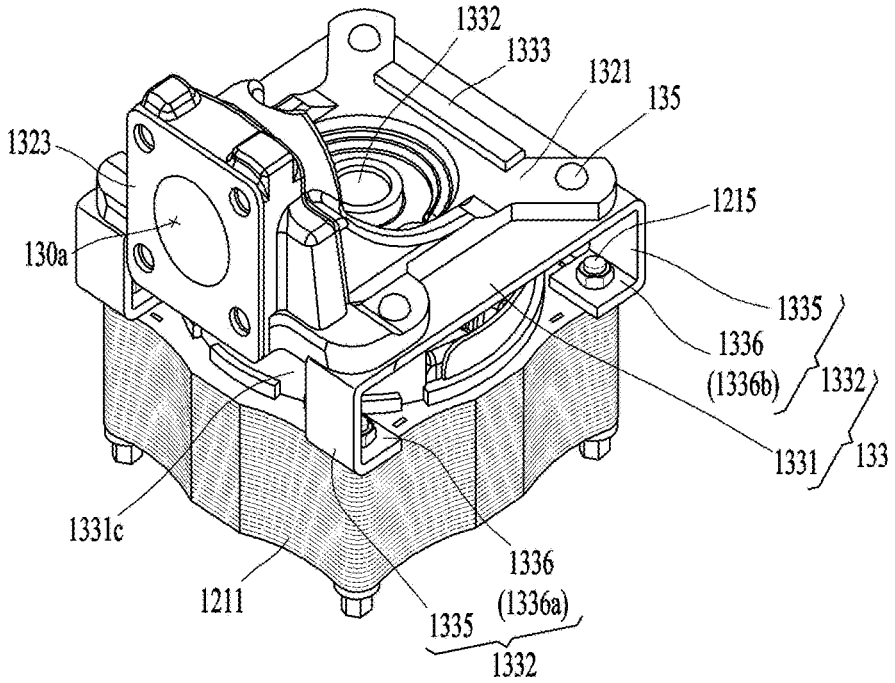
FIG. 11 is a perspective view illustrating an example of the support plate.

FIG. 11 is a perspective view illustrating an example of a support plate. FIG. 12 is a front view of FIG. 11.

Referring to FIGS. 11 and 12, a basic configuration and an operational effect of a compression unit 130 including a support plate 133 are similar to those of the compression unit 130 in the implementation described above. For example, the compression unit 130 can include a piston 131, a cylinder block 132, and a support plate 133, and the cylinder block 132 can be coupled to a stator 121 by the support plate 133 to be supported in an axial direction of a drive shaft 125. Accordingly, volume of the cylinder block 132 can be decreased, thereby reducing a weight of the cylinder block 132 and the compression unit 130 including the same.

The cylinder block 132 includes a frame portion 1321, a bearing portion 1322, and a cylinder portion 1323. The frame portion 1321, the bearing portion 1322, and the cylinder portion 1323 can be manufactured by casting to be configured as a single body. Accordingly, perpendicularity between the bearing portion 1322 and the cylinder portion 1323 each included in the cylinder block 132 can be secured, and at the same time, roundness thereof can be also secured.

In addition, the support plate 133 can include a block support surface portion 1331 and a plurality of block support protrusions 1332. The block support surface portion 1331 and the plurality of block support protrusions 1332 can be manufactured of sheet metal to be configured as a single body. For example, the block support surface portion 1331 can have an approximately "⊏" shape (e.g., a bracket shape), and the plurality of block support protrusions 1332 can be disposed to be bent from respective corners including both ends of the block support surface portion 1331 toward the stator 121, respectively.

The plurality of block support protrusions 1332 can include a plurality of bent portions 1335 each bent from the block support surface portion 1331 toward an axial side surface (an upper side surface) of the stator 121, and a plurality of block support portions 1336 bent from the plurality of bent portions 1335, respectively, along an axial side surface of the stator 121. Accordingly, even when the support plate 133 is manufactured of sheet metal, the cylinder block 132 can be stably supported on the stator 121.

In some implementations, the plurality of support portions 1336 are disposed symmetrically with reference to the second center line CL2 of FIG. 7, and each of the plurality of support portions 1336 can be bent to face away from an inner circumferential surface of the shell 110. In other words, with reference to the second center line CL2 (or an axial center), a first support portion 1336*a* located on a side on which the cylinder portion 1323 is disposed and a second support portion 1336*b* located on a side opposite to the cylinder portion 1323 can be respectively bent in a direction facing away from an inner circumferential surface of the shell 110. Accordingly, among the plurality of block support protrusions 1332 extending from the block support surface portion 1331, both block support protrusions 1332 bent on the side on which the cylinder portion 1323 is disposed and block support protrusions 1332 bent on the opposite side to the cylinder portion 1323 are located far away from the second center line CL2 (or an axial center).

As described above, when the plurality of support portions 1336 are all bent in a direction facing away from an inner circumferential surface of the shell 110, the plurality of bent portions 1335 can be bent from the block support surface portion 1331 at positions far away from the second center line CL2 as possible. In other words, as illustrated in FIG. 12, a first support length L1 to the first support portion 1336*a* and a second support length L2 to the second support portion 1336*b* with reference to an axial center Os can be increased toward both sides. Thus, a length of the block support surface portion 1331 is increased, and in correspondence with this, support force with respect to the cylinder block 132 can be provided widely. Accordingly, an overturning moment of the cylinder block 132 can be decreased, thereby stably supporting the cylinder block 132.

In some implementations, the plurality of support portions 1336 can be all bent in a direction toward an inner circumferential surface of the shell 110. In this case, the plurality of bent portions 1335 can be bent from the block support surface portion 1331 at positions adjacent to the second center line CL2 as possible. Accordingly, a length of the block support surface portion 1331 is decreased to a minimum, and in correspondence with this, a weight of the support plate 133 and the compression unit 130 including the support plate 133 can be reduced. Also, in this case, the support plate 133 can be made by casting, other than by sheet metal processing.

Hereinafter, an example of a support plate is described.

In some implementations, block support protrusions of a support plate are disposed to be symmetrical to each other. However, in some cases, block support protrusions of a support plate can be disposed to be asymmetrical to each other.

Figure 13:
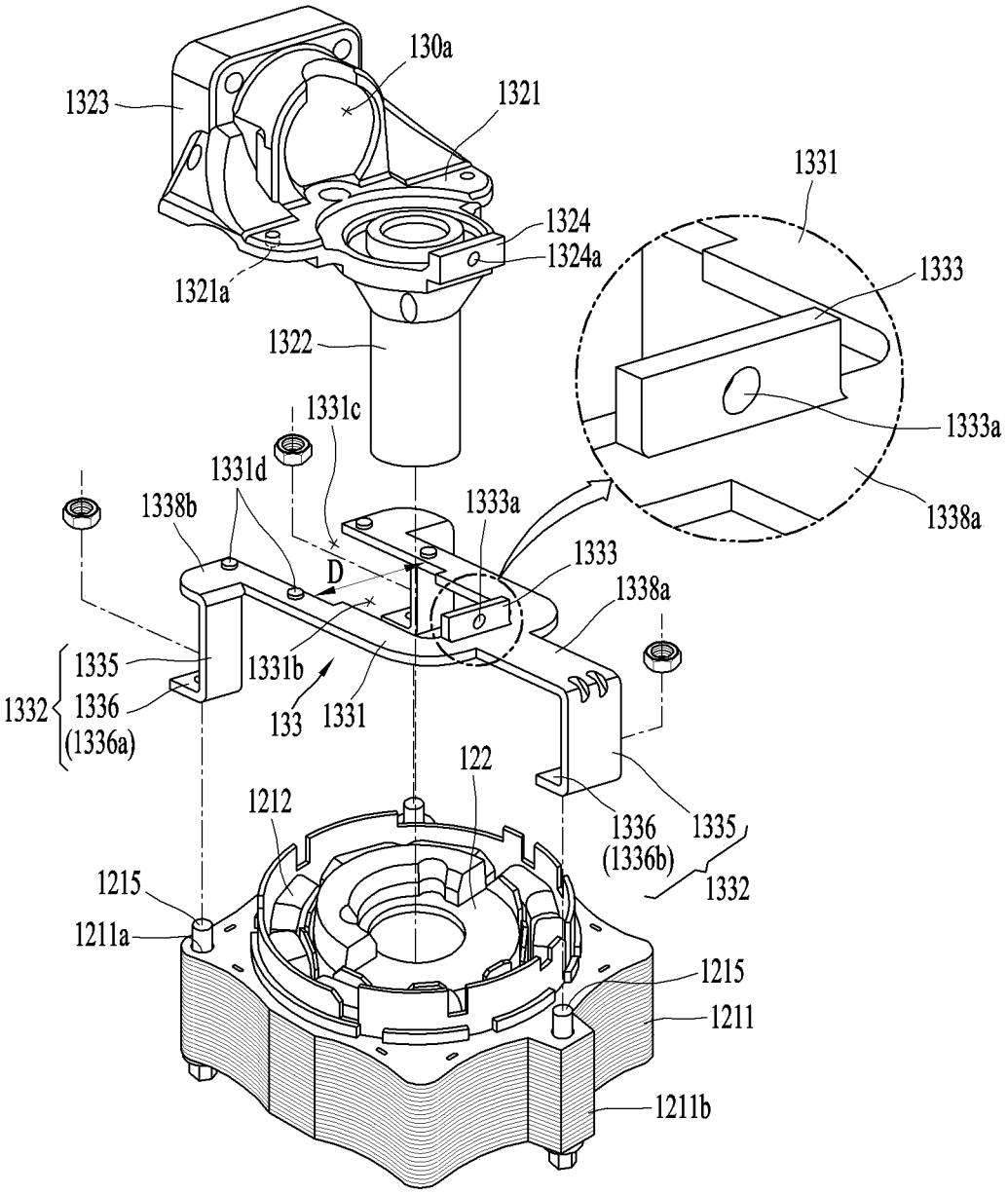
FIG. 13 is an exploded perspective view illustrating an example of the support plate.
Figure 14:
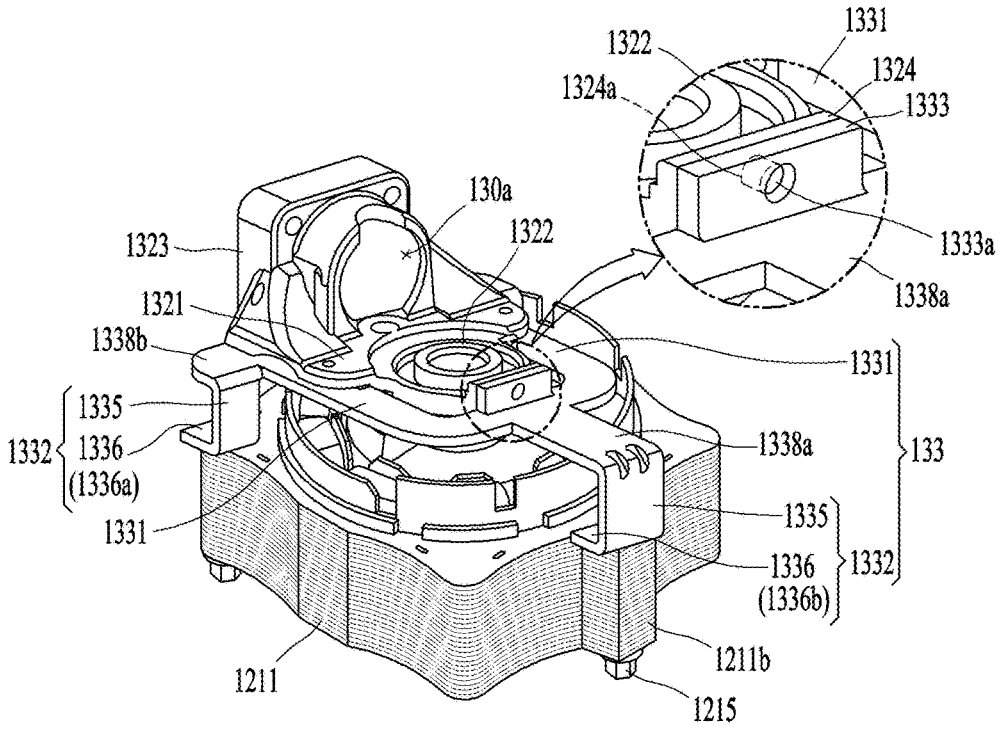
FIG. 14 is an assembled perspective view of FIG. 13.
Figure 15:
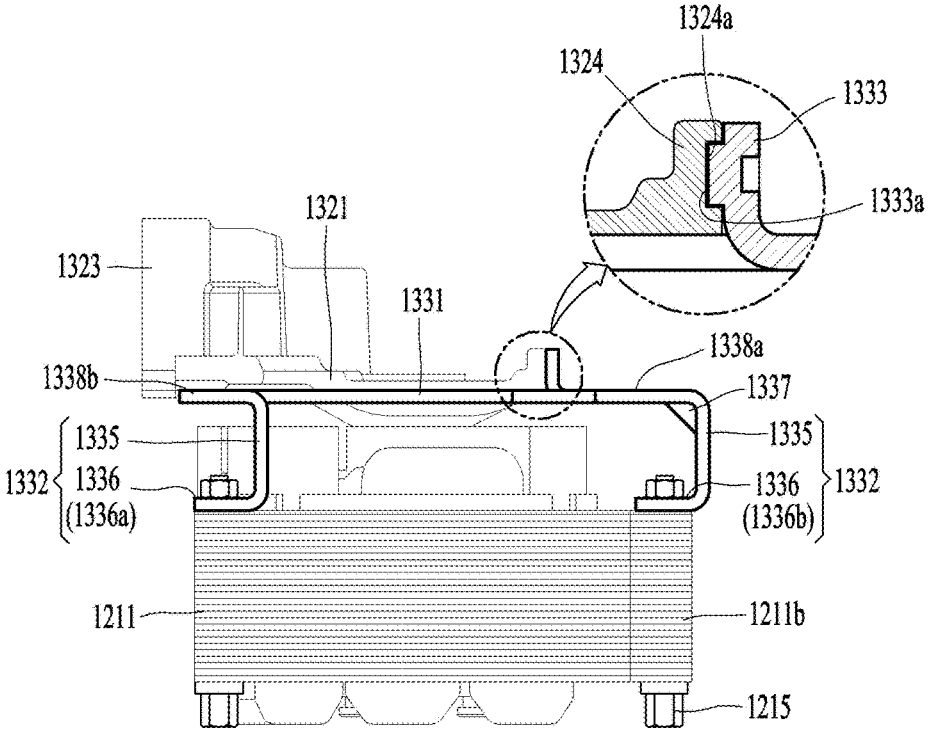
FIG. 15 is a front view of the support plate of FIG. 14.
Figure 16:
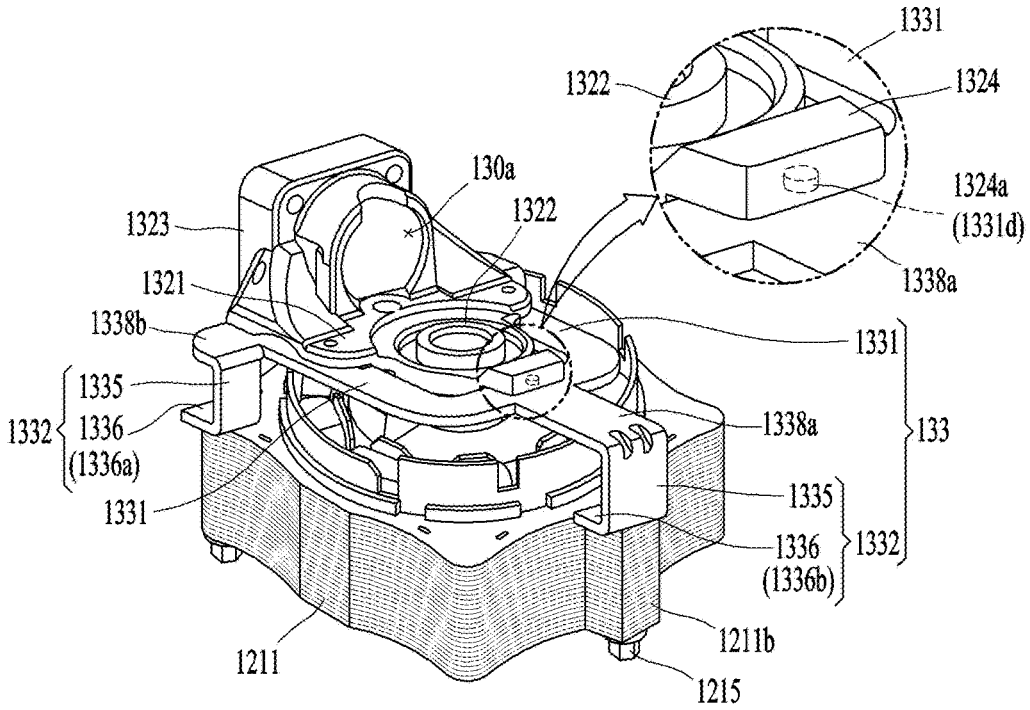
FIG. 16 is a perspective view illustrating an example of the support plate.
Figure 17:
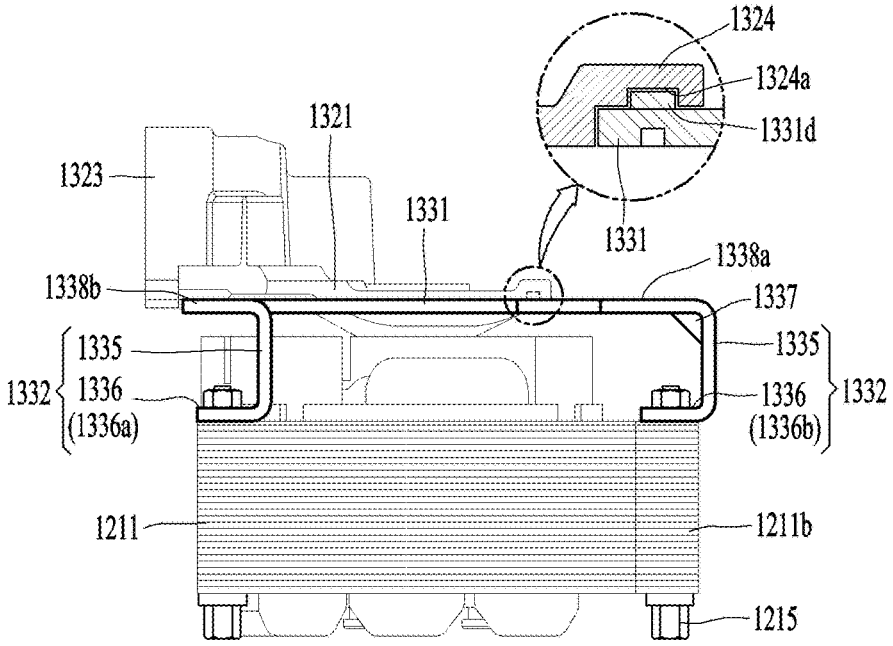
FIG. 17 is a front view of FIG. 16.

FIG. 13 is an exploded perspective view illustrating an example of a support plate. FIG. 14 is an assembled perspective view of FIG. 13. FIG. 15 is a front view of FIG. 14. FIG. 16 is a perspective view illustrating an example of the support plate. FIG. 17 is a front view of FIG. 16.

Referring to FIGS. 13 to 15, a basic configuration and an operational effect of a compression unit 130 including a support plate 133 are similar to those of the compression unit 130 in the implementations described above. For example, the compression unit 130 can include a piston 131, a cylinder block 132, and a support plate 133, and the cylinder block 132 can be coupled to a stator 121 by the support plate 133 to be supported in an axial direction of the drive shaft 125. Accordingly, volume of the cylinder block 132 can be decreased, thereby reducing a weight of the cylinder block 132 and the compression unit 130 including the same.

The cylinder block 132 can include a frame portion 1321, a bearing portion 1322, and a cylinder portion 1323. The frame portion 1321, the bearing portion 1322, and the cylinder portion 1323 can be manufactured by casting to be configured as a single body. Accordingly, perpendicularity between the bearing portion 1322 and the cylinder portion 1323 each included in the cylinder block 132 can be maintained, and at the same time, roundness thereof can be also secured.

In addition, the support plate 133 can include a block support surface portion 1331 and a plurality of block support protrusions 1332. The block support surface portion 1331 and the plurality of block support protrusions 1332 can be manufactured of sheet metal to be configured as a single body. For example, the block support surface portion 1331 can have an approximately "⊏" (e.g., a bracket shape) or "⊂" shape (e.g., a rotated U shape), and the plurality of block support protrusions 1332 can be disposed to be bent from corners of the block support surface portion 1331 and a portion between the corners, respectively, toward the stator 121.

The plurality of block support protrusions 1332 can include a plurality of bent portions 1335 bent from the block support surface portion 1331 toward an axial side surface of the stator 121, and a plurality of support portions 1336 bent from the plurality of bent portions 1335, respectively, along an axial side surface of the stator 121. Accordingly, even when the support plate 133 is manufactured of sheet metal, the cylinder block 132 can be stably supported on the stator 121.

Also, in this case, as described with reference to the above-described implementation of FIG. 3, the plurality of support portions 1336 can be disposed symmetrically with reference to the first center line CL1 and asymmetrically with reference to the second center line CL2, respectively. Alternatively, like the above-described implementation of FIG. 11, the plurality of support portions 1336 can be disposed symmetrically with reference to the first center line CL1 and the second center line CL2, respectively.

In some implementations, the block support surface portion 1331 can be configured to have a "⊂" shape (e.g., a rotated U shape), and the plurality of block support protrusions 1332 can be disposed to be bent from corners of the block support surface portion 1331 and a portion between the corners, respectively, toward the stator 121. In other words, a first support portion 1336*a* located on a side on which the cylinder portion 1323 is disposed with reference to the second center line CL2 can be configured to be bent from both side corners of the block support surface portion 1331, i.e., both open ends constituting a cylinder accommodating portion 1331*c*. A second support portion 1336*b* disposed on a side opposite to the cylinder portion 1323 can be disposed to be bent from a portion between the both side corners, i.e., from a middle portion of the both side corners. Accordingly, in some implementations, a total of three block support protrusions 1332 can be disposed.

In this case, the block support protrusions 1332 may not be bent directly from the block support surface portion 1331, but can be configured such that a first extension portion 1338*a* is further disposed between each of the block support protrusions 1332 and the block support surface portion 1331. For example, a block support protrusion 1332 located on the opposite side to the cylinder portion 1323, among the block support protrusions 1332, can be configured such that the block support surface portion 1331 is extended in a radial direction in correspondence with a length of the first extension portion 1338*a*, and then, a bent portion 1335 is bent from an end of the first extension portion 1338*a*, the end opposite to the block support surface portion 1331, in an axial direction of the drive shaft 125. Accordingly, the block support surface portion 1331 can be shortened in correspondence with the length of the first extension portion 1338*a*, thereby reducing a weight of the support plate 133 including the block support surface portion 1331.

Also, in this case, the stator core 1211 can have an outer circumferential surface with a polyhedral shape, such as an approximately hexahedron, like the above-described implementations, and has a plate support protrusion 1211*b* disposed on a side surface opposite to the cylinder portion 1323 with reference to the second center line CL2 of FIG. 7. For example, the plate support protrusion 1211*b* can be disposed to extend in a radial direction to have a support portion 1336 of the block support protrusions 1332 placed thereon and supported in an axial direction of the drive shaft 125. A first fastening hole 1211*a* can be disposed through the plate support protrusion 1211*b* in an axial direction of the drive shaft 125 so that the stator fastening member 1215 is inserted into the first fastening hole 1211*a*. Accordingly, the plurality of block support protrusions 1332 can be coupled to the stator 121 using the stator fastening member 1215 configured to fasten the stator core 1211, like the above-described implementations.

Additionally, in this case, a stopper protrusion 1333 can be disposed on an inner circumferential surface of the block support surface portion 1331, i.e., on an inner circumferential surface of a bearing accommodating groove 1333*b* to protrude in an axial direction of the drive shaft 125, and a block protrusion 1324 of the cylinder block 132 can be disposed on the frame portion 1321 of the cylinder block 132 to protrude in an axial direction of the drive shaft 125 to face the stopper protrusion 1333 of the block support surface portion 1331 in a radial direction. The stopper protrusion 1333 and the block protrusion 1324 can be disposed to at least partially overlap each other on the first center line CL1 in FIG. 7. Thus, the block protrusion 1324 of the cylinder block 132 can be supported in a radial direction by the stopper protrusion 1333 of the block support surface portion 1331. Accordingly, pushing of the cylinder block 132 in a radial direction which can be caused during a suction stroke of the piston 131 can be suppressed.

In addition, the stopper protrusion 1333 can be fastened to the block protrusion 1324 with a separate block fastening member 135 such as a bolt and/or a rivet. Alternatively, the stopper protrusion 1333 can be caulked to the block protrusion 1324. In some examples, an example in which a caulking protrusion 1333*a* and/or a caulking groove 1324*a* are disposed on the stopper protrusion 1333 and/or the block protrusion 1324, respectively, to caulk the caulking protrusion 1333*a* into the caulking groove 1324*a* is illustrated. This also applies to the cylinder block 132 and the support plate 133. For example, a plurality of caulking grooves 1321*b* (or caulking protrusions) can be disposed in one side surface of the cylinder block 132 facing the support plate 133, and a plurality of caulking protrusions 1331*d* (or caulking grooves) caulked into the caulking grooves 1321*b* in the cylinder block 132, respectively, can be disposed on one side surface of the support plate 133 facing the cylinder block 132. This can simplify a process of assembling between the cylinder block 132 and the support plate 133.

In some implementations, second extension portions 1338*b* extending in a radial direction of the drive shaft 125 toward an inner circumferential surface of the shell 110 can be disposed at both ends of the block support surface portion 1331, respectively, and bent portions 1335 of the block support protrusions 1332, described above, can be disposed to be bent from the second extension portions 1338*b* toward the stator 121 in an axial direction of the drive shaft 125, respectively. Accordingly, a lateral space D in the block support surface portion 1331 becomes narrow, and in correspondence with this, a whole area of the block support surface portion 1331 is decreased, thereby reducing a weight of the support plate 133.

In some examples, as shown in FIG. 13, the first extension portion 1338*a* can extend in a first direction along the radial direction, and the second extension portions 1338*b* can extend in a second direction different from the first direction.

When the three block support protrusions 1332 are disposed as described above, a number of processes for coupling the support plate 133 to the stator 121 can be reduced in correspondence with a reduction in the number of block support protrusions 1332. In addition, not only a weight of the support plate 133 can be decreased in correspondence with a reduction in the number of block support protrusions 1332, an area of the block support surface portion 1331 can be also decreased, thereby reducing a whole weight of the support plate 133. Additionally, a weight of the cylinder block 132 can be reduced by simplifying a shape of the frame portion 1321 in the cylinder block 132.

Meanwhile, referring to FIGS. 16 and 17, the block protrusion 1324 can be disposed on the frame portion 1321 of the cylinder block 132 to protruding from a side opposite to the cylinder portion 1323 in a radial direction of the drive shaft 125. In other words, in the frame portion 1321 of the cylinder block 132, at least a portion of the block protrusion 1324 can be disposed to overlap the block support surface portion 1331 in an axial direction of the and the drive shaft 125. Accordingly, the block protrusion 1324 can be placed on the block support surface portion 1331 and supported in the axial direction of the drive shaft 125 so that the cylinder block 132 can be stably supported on the support plate 133.

In this case, the block protrusion 1324 and the stopper protrusion 1333 facing the same can be fastened with each other using the block fastening member 135 such as a rivet, or caulked with each other using a caulking protrusion and a caulking groove each disposed thereon. Accordingly, the cylinder block 132 can be effectively suppressed from being pushed against the support plate 133 in a reciprocating direction of the piston 131 during a compression stroke as well as a suction stroke of the piston 131.

What is claimed is:

1. A reciprocating compressor comprising:

a shell;

a driving motor disposed inside the shell, the driving motor comprising a stator and a rotor;

a drive shaft coupled to the rotor of the driving motor;

a piston coupled to the drive shaft and configured to perform a reciprocating motion;

a cylinder block comprising (i) a cylinder portion that receives the piston and defines a compression chamber with the piston and (ii) a bearing portion that receives the drive shaft and supports the drive shaft in a radial direction of the drive shaft; and a support plate that is disposed between the driving motor and the cylinder block and supports the cylinder block from the driving motor in an axial direction of the drive shaft, wherein the support plate has one side surface coupled to the stator and another side surface coupled to the cylinder block, wherein the support plate comprises:

a first block support portion that supports the cylinder block in the axial direction of the drive shaft, and a plurality of second block support portions that are each bent or curved from the first block support portion toward the stator and disposed on the stator, wherein the stator supports the plurality of second block support portions in the axial direction of the drive shaft, wherein the first block support portion defines:

a bearing accommodating portion that passes through the first block support portion in the axial direction of the drive shaft and surrounds at least a portion of the bearing portion, and a cylinder accommodating portion that is one side of the bearing accommodating portion in the radial direction of the drive shaft and accommodates at least a portion of the cylinder portion, wherein the first block support portion has an arc shape with one open side to define the cylinder accommodating portion at the one side of the bearing accommodating portion in the radial direction of the drive shaft, the first block support portion overlapping with the cylinder portion in the axial direction of the drive shaft, wherein the bearing portion surrounds and is in contact with an outer circumferential surface of the drive shaft, and wherein the bearing portion is accommodated in the stator and disposed below the first block support portion.

2. The reciprocating compressor of claim 1, wherein the first block support portion and the plurality of second block support portions have a same thickness in the axial direction of the drive shaft.

3. The reciprocating compressor of claim 1, wherein each of the plurality of second block support portions comprises:

a bent portion that is bent from the first block support portion toward an axial side surface of the stator and extends in the axial direction of the drive shaft; and a support portion that is bent from an end of the bent portion and extends along the axial side surface of the stator, the support portion being supported by the axial side surface of the stator in the axial direction of the drive shaft.

4. The reciprocating compressor of claim 3, further comprising a plurality of stator fastening members that pass through the stator, each of the stator fastening members being coupled to the support portion of one of the plurality of second block support portions.

5. The reciprocating compressor of claim 3, wherein the support portions are bent from the bent portions, respectively, in a same direction along a reciprocating direction of the piston.

6. The reciprocating compressor of claim 5, wherein the cylinder portion is disposed at a first side with respect to an axial center axis of the rotor that is perpendicular to the reciprocating direction of the piston, and wherein the support portions comprise:

a first support portion disposed at the first side with respect to the axial center axis of the rotor and is bent in a direction toward an inner circumferential surface of the shell facing the cylinder portion in the reciprocating direction of the piston; and a second support portion that is disposed at a second side with respect to the axial center axis of the rotor opposite to the first side and is bent in the direction toward the inner circumferential surface of the shell.

7. The reciprocating compressor of claim 5, wherein the cylinder portion is disposed at a first side with respect to an axial center axis of the rotor that is perpendicular to the reciprocating direction of the piston, and wherein the support portions comprise:

a first support portion disposed at the first side with respect to the axial center axis of the rotor and is bent in a direction away from an inner circumferential surface of the shell facing the cylinder portion in the reciprocating direction of the piston; and a second support portion that is disposed at a second side with respect to the axial center axis of the rotor opposite to the first side and is bent in the direction away from the inner circumferential surface of the shell.

8. The reciprocating compressor of claim 3, wherein the support portions are bent from the bent portions, respectively, in opposite directions to each other along a reciprocating direction of the piston.

9. The reciprocating compressor of claim 8, wherein the cylinder portion is disposed at a first side with respect to an axial center axis of the rotor that is perpendicular to the reciprocating direction of the piston, and wherein the support portions comprise:

a first support portion disposed at the first side with respect to the axial center axis of the rotor and is bent in a first direction away from an inner circumferential surface of the shell facing the cylinder portion in the reciprocating direction of the piston; and a second support portion that is disposed at a second side with respect to the axial center axis of the rotor opposite to the first side and is bent in a second direction toward the inner circumferential surface of the shell.

10. The reciprocating compressor of claim 8, wherein the cylinder portion is disposed at a first side with respect to an axial center axis of the rotor that is perpendicular to the reciprocating direction of the piston, and wherein the support portions comprise:

a first support portion disposed at the first side with respect to the axial center axis of the rotor and is bent in a first direction toward an inner circumferential surface of the shell facing the cylinder portion in the reciprocating direction of the piston; and a second support portion that is disposed at a second side with respect to the axial center axis of the rotor opposite to the first side and is bent in a second direction away from the inner circumferential surface of the shell facing the cylinder portion.

11. The reciprocating compressor of claim 1, wherein the support plate comprises:

at least one curved or bent portion; and at least one reinforcement rib disposed at the at least one curved or bent portion.

12. The reciprocating compressor of claim 1, further comprising:

a stopper protrusion that protrudes from the support plate in the axial direction of the drive shaft and is in contact with the cylinder block, wherein the stopper protrusion supports at least a part of the cylinder block in a reciprocating direction of the piston.

13. The reciprocating compressor of claim 1, wherein the cylinder block is made of a first material, and the support plate is made of a second material that is lighter than the first material of the cylinder block.

14. The reciprocating compressor of claim 1, further comprising:

a separate block fastening member that passes through the cylinder block and the support plate and fastens the cylinder block and the support plate to each other.

15. The reciprocating compressor of claim 1, wherein the stator and the cylinder portion face each other in the axial direction with the one open side of the first block support portion therebetween.

16. A reciprocating compressor comprising:

a shell;

a driving motor disposed inside the shell, the driving motor comprising a stator and a rotor;

a drive shaft coupled to the rotor of the driving motor;

a piston coupled to the drive shaft and configured to perform a reciprocating motion;

a cylinder block comprising (i) a cylinder portion that receives the piston and defines a compression chamber with the piston, and (ii) a bearing portion that receives the drive shaft and supports the drive shaft in a radial direction of the drive shaft; and a support plate that is disposed between the driving motor and the cylinder block and supports the cylinder block from the driving motor in an axial direction of the drive shaft, wherein the support plate comprises:

a block support surface portion that supports the cylinder block in the axial direction of the drive shaft, and a plurality of block support protrusions that are each bent or curved from the block support surface portion toward the stator and disposed on the stator, wherein the stator supports the plurality of block support protrusions in the axial direction of the drive shaft, wherein the block support surface portion comprises a surface that faces the cylinder portion and is recessed in an arc shape defining one open side of the block support surface portion to thereby define a cylinder accommodating portion that overlaps with the cylinder portion in the axial direction of the drive shaft, wherein the one open side of the block support surface portion is defined between a pair of ends of the block support surface portion that are spaced apart from each other, wherein the bearing portion surrounds and is in contact with an outer circumferential surface of the drive shaft, and wherein the bearing portion is accommodated in the stator and disposed below the block support surface portion.

17. The reciprocating compressor of claim 16, wherein the plurality of block support protrusions are arranged (i) symmetrical with respect to a first center line that extends in a reciprocating direction of the piston and (ii) asymmetrical with respect to a second center line that is perpendicular to the first center line and extends in the axial direction of the rotor.

18. The reciprocating compressor of claim 16, wherein the plurality of block support protrusions are arranged symmetrical with respect to (i) a first center line that extends in a reciprocating direction of the piston and (ii) a second center line that is perpendicular to the first center line and extends in the axial direction of the rotor.

19. The reciprocating compressor of claim 16, wherein the plurality of block support protrusions are curved or bent from corners of the block support surface portion, respectively, and wherein the stator has a polyhedral shape with a plurality of corners, each of the plurality of corners supporting one of the plurality of block support protrusions in the axial direction of the drive shaft.

20. The reciprocating compressor of claim 16, wherein at least one of the plurality of block support protrusions is bent from an intermediate portion between corners of the block support surface portion.

21. The reciprocating compressor of claim 20, wherein at least one of the plurality of block support protrusions is located at a first center line that extends in a reciprocating direction of the piston.

22. The reciprocating compressor of claim 20, wherein the stator has a polyhedral shape with a plurality of corners, and wherein the stator comprises a plate support protrusion that is disposed between the plurality of corners of the stator and protrudes outward in the radial direction, the plate support protrusion supporting at least one of the plurality of block support protrusions in the axial direction of the drive shaft.

23. The reciprocating compressor of claim 22, wherein the block support surface portion comprises a first extension portion that is disposed between the ends of the block support surface portion and extends outward in a first direction, and wherein at least one of the plurality of block support protrusions is bent from the first extension portion and supported on the plate support protrusion of the stator.

24. The reciprocating compressor of claim 23, wherein the block support surface portion further comprises a second extension portion that is disposed at at least one of the ends of the block support surface portion and extends outward in a second direction, and wherein one of the plurality of block support protrusions is bent from the second extension portion and supported on one of the plurality of corners of the stator.

* * * * *